US010308265B2

(12) United States Patent
Fahmy

(10) Patent No.: US 10,308,265 B2
(45) **Date of Patent: *Jun. 4, 2019**

(54) VEHICLE CONTROL SYSTEM AND METHOD

(71) Applicant: General Electric Company, Schenectady, NY (US)

(72) Inventor: Sameh Fahmy, Montreal (CA)

(73) Assignee: GE GLOBAL SOURCING LLC, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/044,592

(22) Filed: Feb. 16, 2016

(65) Prior Publication Data

US 2016/0159381 A1 Jun. 9, 2016

Related U.S. Application Data

(63) Continuation-in-part of application No. 14/922,787, filed on Oct. 26, 2015, which is a continuation-in-part (Continued)

(51) Int. Cl.
*B61L 23/04* (2006.01)
*B61L 27/00* (2006.01)

(Continued)

(52) U.S. Cl.
CPC ..... *B61L 27/0088* (2013.01); *B61K 9/10* (2013.01); *B61L 15/0081* (2013.01); *B61L 23/044* (2013.01); *B61L 27/0094* (2013.01)

(58) Field of Classification Search
CPC ..... B61L 23/044; B61L 15/0027; B61L 15/0072; B61L 3/006; B61L 15/0081;

(Continued)

(56) References Cited

U.S. PATENT DOCUMENTS 2,059,160 A 10/1936 Wintsch
2,104,601 A 1/1938 Young (Continued)

FOREIGN PATENT DOCUMENTS

AU 2007202928 A1 10/2007
AU 2010256020 A1 12/2011

(Continued)

OTHER PUBLICATIONS

Non-Final Rejection towards related U.S. Appl. No. 12/365,359 dated Oct. 6, 2011.

(Continued)

*Primary Examiner* — Alesa Allgood
(74) *Attorney, Agent, or Firm* — Christopher R. Carroll; The Small Patent Law Group LLC

(57) ABSTRACT

A system and method for examining a route and/or vehicle system obtain a route parameter and/or a vehicle parameter from discrete examinations of the route and/or the vehicle system. The system includes a controller and route examination equipment. The route examination equipment obtains a route parameter indicative of a condition of a route over which a vehicle system travels. The controller receives the route parameter, and examines the route parameter to determine the condition of the route. The controller can control at least one operational aspect of the vehicle system in response to the determined condition of the route.

19 Claims, 4 Drawing Sheets

Related U.S. Application Data of application No. 14/155,454, filed on Jan. 15, 2014, and a continuation-in-part of application No. 12/573,141, filed on Oct. 4, 2009, now Pat. No. 9,233,696, said application No. 14/155,454 is a continuation of application No. PCT/US2013/054284, filed on Aug. 9, 2013, said application No. 12/573,141 is a continuation-in-part of application No. 11/385,354, filed on Mar. 20, 2006.

(60) Provisional application No. 62/134,518, filed on Mar. 17, 2015, provisional application No. 61/681,843, filed on Aug. 10, 2012, provisional application No. 61/729,188, filed on Nov. 21, 2012, provisional application No. 61/860,469, filed on Jul. 31, 2013, provisional application No. 61/860,496, filed on Jul. 31, 2013.

(51) Int. Cl.
*B61L 15/00* (2006.01)
*B61K 9/10* (2006.01)

(58) Field of Classification Search
CPC .... B61L 27/0027; B61L 25/02; B61L 23/041; B61L 27/0094; B61L 15/0018; B61L 2205/04; B61L 25/021; B61L 25/025; B61L 25/023; B61L 3/125; B61L 27/0038; B61L 27/0088; B61L 29/30; B61L 15/0036; B61L 15/0054; B61L 23/042; B61L 23/047; B61L 27/0077; B60L 2200/26; G01R 31/006; B61K 9/10
See application file for complete search history.

(56) References Cited

U.S. PATENT DOCUMENTS 2,104,652 A 1/1938 Inman
2,111,513 A 3/1938 Phinney
2,148,005 A 2/1939 Allen et al.
2,233,932 A 3/1941 Allen
2,289,857 A 7/1942 Allen
2,293,926 A 8/1942 Wallace
2,366,802 A 1/1945 Pflasterer
2,601,634 A 6/1952 Rivette
2,628,335 A 2/1953 Drake
2,783,369 A 2/1957 Weber
2,925,552 A 2/1960 Cowan et al.
2,927,711 A 3/1960 Naggiar
3,016,464 A 1/1962 Bailey
3,137,756 A 6/1964 Gunther et al.
3,246,141 A 4/1966 Ehrlich
3,393,600 A 7/1968 Bess
3,508,496 A 4/1970 Larson
3,517,307 A 6/1970 Wallen, Jr. et al.
3,519,805 A 7/1970 Thorne-Booth
3,537,401 A 11/1970 Metzner
3,562,419 A 2/1971 Stewart et al.
3,575,596 A 4/1971 Schatzel
3,589,815 A 6/1971 Hosterman
3,594,912 A 7/1971 Sauterel
3,604,359 A 9/1971 Doorley et al.
3,633,010 A 1/1972 Svetlichny
3,650,216 A 3/1972 Harwick et al.
3,655,962 A 4/1972 Koch
3,696,243 A 10/1972 Risely
3,718,040 A 2/1973 Freeman et al.
3,781,139 A 12/1973 Lohse
3,791,473 A 2/1974 Rosen
3,794,833 A 2/1974 Blazek et al.
3,805,056 A 4/1974 Birkin
3,813,885 A 6/1974 Tabor
3,821,558 A 6/1974 Mansfield
3,821,932 A 7/1974 Theurer et al.
3,828,440 A 8/1974 Plasser et al.
3,850,390 A 11/1974 Geiger
3,864,039 A 2/1975 Wilmarth
3,865,042 A 2/1975 Depaola et al.
3,870,952 A 3/1975 Sibley
3,875,865 A 4/1975 Plasser et al.
3,886,870 A 6/1975 Pelabon
3,896,665 A 7/1975 Goel
3,924,461 A 12/1975 Stover
3,937,068 A 2/1976 Joy
3,937,432 A 2/1976 Birkin
3,948,314 A 4/1976 Creswick et al.
3,960,005 A 6/1976 Vezina
3,962,908 A 6/1976 Joy
3,974,991 A 8/1976 Geiger
3,987,989 A 10/1976 Geiger
3,995,560 A 12/1976 Mackintosh
4,003,019 A 1/1977 Tronel
4,005,601 A 2/1977 Botello
4,005,838 A 2/1977 Grundy
4,022,408 A 5/1977 Staples
4,040,738 A 8/1977 Wagner
4,041,283 A 8/1977 Mosier
4,042,810 A 8/1977 Mosher
4,044,594 A 8/1977 Owens et al.
4,062,419 A 12/1977 Kadota
4,069,590 A 1/1978 Effinger
4,075,632 A 2/1978 Baldwin et al.
4,100,795 A 7/1978 Panetti
4,117,463 A 9/1978 Norton
4,117,529 A 9/1978 Stark et al.
4,136,432 A 1/1979 Melley, Jr.
4,143,553 A 3/1979 Martens et al.
4,145,018 A 3/1979 Poggio et al.
4,155,176 A 5/1979 Goel et al.
4,159,088 A 6/1979 Cosley
4,165,648 A 8/1979 Pagano
4,173,073 A 11/1979 Fukazawa et al.
4,174,636 A 11/1979 Pagano
4,181,278 A 1/1980 Pascoe
4,181,430 A 1/1980 Shirota et al.
4,181,943 A 1/1980 Mercer, Sr. et al.
4,198,164 A 4/1980 Cantor
4,207,569 A 6/1980 Meyer
4,214,647 A 7/1980 Lutts
4,222,275 A 9/1980 Sholl et al.
4,229,978 A 10/1980 Sholl et al.
4,235,112 A 11/1980 Kaiser
4,241,403 A 12/1980 Schultz
4,253,399 A 3/1981 Spigarelli
4,259,018 A 3/1981 Poirier
4,262,209 A 4/1981 Berner
4,279,395 A 7/1981 Boggio et al.
4,288,855 A 9/1981 Panetti
4,306,694 A 12/1981 Kuhn
4,324,376 A 4/1982 Kuhn
4,344,364 A 8/1982 Nickles et al.
4,355,582 A 10/1982 Germer
4,360,873 A 11/1982 Wilde et al.
4,361,202 A 11/1982 Minovitch
4,383,448 A 5/1983 Fujimoto et al.
4,389,033 A 6/1983 Hardman
4,391,134 A 7/1983 Theurer et al.
4,401,035 A 8/1983 Spigarelli et al.
4,417,466 A 11/1983 Panetti
4,417,522 A 11/1983 Theurer et al.
4,425,097 A 1/1984 Owens
4,429,576 A 2/1984 Norris
4,430,615 A 2/1984 Calvert
4,457,178 A 7/1984 Turbe et al.
4,467,430 A 8/1984 Even et al.
4,468,966 A 9/1984 Bradshaw
4,487,071 A 12/1984 Pagano et al.
4,490,038 A 12/1984 Theurer et al.
4,524,745 A 6/1985 Tominari et al.
4,531,837 A 7/1985 Panetti
4,538,061 A 8/1985 Jaquet
4,541,182 A 9/1985 Panetti

(56) References Cited

U.S. PATENT DOCUMENTS 4,548,070 A 10/1985 Panetti
4,548,164 A 10/1985 Yloenen et al.
4,561,057 A 12/1985 Haley, Jr. et al.
4,565,548 A 1/1986 Davis et al.
4,577,494 A 3/1986 Jaeggi
4,578,665 A 3/1986 Yang
4,582,280 A 4/1986 Nichols et al.
4,582,580 A 4/1986 Goudal et al.
4,593,569 A 6/1986 Joy
4,602,335 A 7/1986 Perlmutter
4,609,870 A 9/1986 Lale et al.
4,615,218 A 10/1986 Pagano
4,625,412 A 12/1986 Bradshaw
4,644,705 A 2/1987 Saccomani et al.
4,654,973 A 4/1987 Worthy
4,655,142 A 4/1987 Theurer et al.
4,662,224 A 5/1987 Turbe
4,663,713 A 5/1987 Cornell et al.
4,689,995 A 9/1987 Turbe
4,691,565 A 9/1987 Theurer
4,700,223 A 10/1987 Shoutaro et al.
4,700,574 A 10/1987 Turbe
4,711,418 A 12/1987 Auer, Jr. et al.
4,718,351 A 1/1988 Engle
4,723,738 A 2/1988 Franke
4,728,063 A 3/1988 Petit et al.
4,735,384 A 4/1988 Elliott
4,735,385 A 4/1988 Nickles et al.
4,741,207 A 5/1988 Spangler
4,763,526 A 8/1988 Pagano
4,773,590 A 9/1988 Dash et al.
4,794,548 A 12/1988 Lynch et al.
4,827,438 A 5/1989 Nickles et al.
4,843,575 A 6/1989 Crane
4,853,883 A 8/1989 Nickles et al.
4,886,226 A 12/1989 Frielinghaus
4,915,504 A 4/1990 Thurston
4,932,614 A 6/1990 Birkin
4,932,618 A 6/1990 Davenport et al.
4,944,474 A 7/1990 Jones
4,979,392 A 12/1990 Guinon
4,986,498 A 1/1991 Roller et al.
5,009,014 A 4/1991 Leach
5,036,594 A 8/1991 Kesler et al.
5,055,835 A 10/1991 Sutton
5,086,591 A 2/1992 Panetti
5,094,004 A 3/1992 Wooten
5,101,358 A 3/1992 Panetti
5,109,343 A 4/1992 Budway
5,129,605 A 7/1992 Burns et al.
5,133,645 A 7/1992 Crowley et al.
5,134,808 A 8/1992 Panetti
5,140,776 A 8/1992 Isdahl et al.
5,161,891 A 11/1992 Austin
5,177,684 A 1/1993 Harker et al.
5,181,541 A 1/1993 Bodenheimer
5,187,945 A 2/1993 Dixon
5,197,438 A 3/1993 Kumano et al.
5,197,627 A 3/1993 Disabato et al.
5,199,176 A 4/1993 Theurer et al.
5,201,294 A 4/1993 Osuka
5,203,089 A 4/1993 Trefouel et al.
5,230,613 A 7/1993 Hilsbos et al.
5,240,416 A 8/1993 Bennington
5,253,153 A 10/1993 Mathews et al.
5,253,830 A 10/1993 Nayer et al.
5,261,366 A 11/1993 Regueiro
5,275,051 A 1/1994 De Beer
5,277,156 A 1/1994 Osuka et al.
5,301,548 A 4/1994 Theurer
5,313,924 A 5/1994 Regueiro
5,316,174 A 5/1994 Schutz
5,339,692 A 8/1994 Shoenhair et al.
5,341,683 A 8/1994 Searle
5,353,512 A 10/1994 Theurer et al.
5,357,912 A 10/1994 Barnes et al.
5,363,787 A 11/1994 Konopasek et al.
5,365,902 A 11/1994 Hsu
5,386,727 A 2/1995 Searle
5,388,034 A 2/1995 Allen et al.
5,394,851 A 3/1995 Cryer et al.
5,398,186 A 3/1995 Nakhla
5,398,894 A 3/1995 Pascoe
5,419,196 A 5/1995 Havira et al.
5,420,883 A 5/1995 Swensen et al.
5,429,329 A 7/1995 Wallace et al.
5,433,111 A 7/1995 Hershey et al.
5,433,182 A 7/1995 Augustin et al.
5,437,422 A 8/1995 Newman
5,441,027 A 8/1995 Buchanon et al.
5,452,222 A 9/1995 Gray et al.
5,459,663 A 10/1995 Franke
5,459,666 A 10/1995 Casper et al.
5,460,013 A 10/1995 Thomsen
5,462,244 A 10/1995 Van Der Hoek et al.
5,475,597 A 12/1995 Buck
5,487,002 A 1/1996 Diller et al.
5,487,516 A 1/1996 Murata et al.
5,492,099 A 2/1996 Maddock
5,522,265 A 6/1996 Jaeggi
5,529,267 A 6/1996 Giras et al.
5,533,695 A 7/1996 Heggestad et al.
5,565,874 A 10/1996 Rode
5,570,284 A 10/1996 Roselli et al.
5,574,224 A 11/1996 Jaeggi
5,574,649 A 11/1996 Levy
5,574,659 A 11/1996 Delvers et al.
5,578,758 A 11/1996 Havira et al.
5,579,013 A 11/1996 Hershey et al.
5,583,769 A 12/1996 Saitoh
5,588,716 A 12/1996 Stumpe
5,598,782 A 2/1997 Wiseman et al.
5,600,558 A 2/1997 Mearek et al.
5,605,099 A 2/1997 Sroka et al.
5,605,134 A 2/1997 Martin
5,613,442 A 3/1997 Ahola et al.
5,618,179 A 4/1997 Copperman et al.
5,623,244 A 4/1997 Cooper
5,627,508 A 5/1997 Cooper et al.
5,628,479 A 5/1997 Ballinger
5,636,026 A 6/1997 Mian et al.
5,642,827 A 7/1997 Madsen
5,651,330 A 7/1997 Jewett
RE35,590 E 8/1997 Bezos et al.
5,676,059 A 10/1997 Alt
5,680,054 A 10/1997 Gauthier
5,680,120 A * 10/1997 Tilleman ..... B61L 23/041
246/106
5,681,015 A 10/1997 Kull
5,698,977 A 12/1997 Simpson et al.
5,699,986 A 12/1997 Welk
5,713,540 A 2/1998 Gerszberg et al.
5,719,771 A 2/1998 Buck et al.
5,720,455 A 2/1998 Kull et al.
5,721,685 A 2/1998 Holland et al.
5,735,492 A 4/1998 Pace
5,738,311 A 4/1998 Fernandez
5,740,547 A 4/1998 Kull et al.
5,743,495 A 4/1998 Welles, II et al.
5,751,144 A 5/1998 Weischedel
5,755,349 A 5/1998 Brundle
5,756,903 A 5/1998 Norby et al.
5,758,299 A 5/1998 Sandborg et al.
5,769,364 A 6/1998 Cipollone
5,775,228 A 7/1998 Lamba et al.
5,777,891 A 7/1998 Pagano et al.
5,785,392 A 7/1998 Hart
5,786,535 A 7/1998 Takeuchi et al.
5,786,750 A 7/1998 Cooper
5,791,063 A 8/1998 Kesler et al.
5,803,411 A 9/1998 Ackerman et al.
5,804,731 A 9/1998 Jaeggi
5,813,635 A 9/1998 Fernandez
5,817,934 A 10/1998 Skantar

(56) References Cited

U.S. PATENT DOCUMENTS 5,820,226 A 10/1998 Hart
5,828,979 A 10/1998 Polivka et al.
5,832,895 A 11/1998 Takahashi et al.
5,833,325 A 11/1998 Hart
5,836,529 A 11/1998 Gibbs
5,856,802 A 1/1999 Ura et al.
5,867,404 A 2/1999 Bryan
5,913,170 A 6/1999 Wortham
5,924,654 A 7/1999 Anderson
5,928,294 A 7/1999 Zelinkovsky
5,934,764 A 8/1999 Dimsa et al.
5,936,517 A 8/1999 Yeh
5,944,392 A 8/1999 Tachihata et al.
5,950,966 A 9/1999 Hungate et al.
5,950,967 A 9/1999 Montgomery
5,956,664 A 9/1999 Bryan
5,957,571 A 9/1999 Koster et al.
5,969,643 A 10/1999 Curtis
5,970,438 A 10/1999 Clark et al.
5,978,718 A 11/1999 Kull
5,983,144 A 11/1999 Bonissone et al.
5,986,547 A 11/1999 Korver et al.
5,986,577 A 11/1999 Bezos
5,986,579 A 11/1999 Halvorson
5,987,979 A 11/1999 Bryan
5,992,241 A 11/1999 Posgay et al.
5,995,737 A 11/1999 Bonissone et al.
5,995,881 A 11/1999 Kull
5,998,915 A 12/1999 Scholz et al.
6,005,494 A 12/1999 Schramm
6,016,791 A 1/2000 Thomas et al.
6,026,687 A 2/2000 Jury
6,055,862 A 5/2000 Martens
6,064,428 A * 5/2000 Trosino ..... B61L 23/044 348/128
6,067,496 A 5/2000 Benoliel et al.
6,067,964 A 5/2000 Ruoff et al.
6,081,769 A 6/2000 Curtis
6,088,635 A 7/2000 Cox et al.
6,092,021 A 7/2000 Ehlbeck et al.
6,102,009 A 8/2000 Nishiyama
6,102,340 A 8/2000 Peek et al.
6,112,142 A 8/2000 Shockley et al.
6,114,901 A 9/2000 Singh et al.
6,119,353 A 9/2000 Gronskov
6,121,924 A 9/2000 Meek et al.
6,123,111 A 9/2000 Nathan et al.
6,125,311 A 9/2000 Lo
6,128,558 A 10/2000 Kernwein
6,129,025 A 10/2000 Minakami et al.
6,135,396 A 10/2000 Whitfield et al.
6,158,416 A 12/2000 Chen et al.
6,158,822 A 12/2000 Shirai et al.
6,163,089 A 12/2000 Kull
6,163,755 A 12/2000 Peer et al.
6,179,252 B1 1/2001 Roop et al.
6,192,863 B1 2/2001 Takase
6,195,020 B1 2/2001 Brodeur, Sr. et al.
6,198,993 B1 3/2001 Higashi et al.
6,216,095 B1 4/2001 Glista
6,216,957 B1 4/2001 Turunen, Jr.
6,219,595 B1 4/2001 Nickles et al.
6,225,919 B1 5/2001 Lumbis et al.
6,230,668 B1 5/2001 Marsh et al.
6,243,694 B1 6/2001 Bonissone et al.
6,262,573 B1 7/2001 Wojnarowski et al.
6,263,265 B1 7/2001 Fera
6,263,266 B1 7/2001 Hawthorne
6,269,034 B1 7/2001 Shibuya
6,270,040 B1 8/2001 Katzer
6,275,165 B1 8/2001 Bezos
6,286,480 B1 9/2001 Chen et al.
6,295,816 B1 10/2001 Gallagher et al.
6,304,801 B1 10/2001 Doner
6,308,117 B1 10/2001 Ryland et al.
6,317,686 B1 11/2001 Ran
6,322,025 B1 11/2001 Colbert et al.
6,324,912 B1 12/2001 Wooh
6,325,050 B1 12/2001 Gallagher et al.
6,332,106 B1 12/2001 Hawthorne et al.
6,347,265 B1 2/2002 Bidaud
6,349,653 B1 2/2002 Siedlarczyk
6,349,702 B1 2/2002 Nishiyama
6,349,706 B1 2/2002 Hsu et al.
6,357,421 B1 3/2002 Pritchard
6,360,998 B1 3/2002 Halvorson et al.
6,363,331 B1 3/2002 Kyrtsos
6,377,215 B1 4/2002 Halvorson et al.
6,380,639 B1 4/2002 Soucy
6,404,129 B1 6/2002 Hendricx et al.
6,405,141 B1 6/2002 Carr et al.
6,415,522 B1 7/2002 Ganz
6,416,020 B1 7/2002 Gronskov
6,417,765 B1 7/2002 Capanna
6,421,606 B1 7/2002 Asai et al.
6,427,114 B1 7/2002 Olsson
6,441,570 B1 8/2002 Grubba et al.
6,443,123 B1 9/2002 Aoki et al.
6,459,964 B1 10/2002 Vu et al.
6,459,965 B1 10/2002 Polivka et al.
6,484,074 B1 11/2002 Hazard et al.
6,487,478 B1 11/2002 Azzaro et al.
6,487,488 B1 11/2002 Peterson, Jr. et al.
6,490,523 B2 12/2002 Doner
6,493,627 B1 12/2002 Gallagher et al.
6,499,339 B1 12/2002 Hedstrom
6,499,815 B1 12/2002 Daigle
6,501,393 B1 12/2002 Richards et al.
6,505,103 B1 1/2003 Howell et al.
6,515,249 B1 2/2003 Valley et al.
6,516,668 B2 2/2003 Havira et al.
6,520,124 B2 2/2003 Bohm, II
6,522,958 B1 2/2003 Dwyer et al.
6,523,787 B2 2/2003 Braband
6,525,658 B2 2/2003 Streetman et al.
6,533,223 B1 3/2003 Ireland
6,549,005 B1 4/2003 Hay et al.
6,549,803 B1 4/2003 Raghavan et al.
6,553,838 B2 4/2003 Amini
6,556,945 B1 4/2003 Burggraf et al.
6,557,526 B1 5/2003 Hoshino
6,564,172 B1 5/2003 Till
6,570,497 B2 5/2003 Puckette, IV et al.
6,571,636 B1 6/2003 Mcwhorter
6,584,953 B2 7/2003 Yomogida
6,585,085 B1 7/2003 Kumar
6,588,114 B1 7/2003 Daigle
6,591,263 B1 7/2003 Becker et al.
6,591,758 B2 7/2003 Kumar
6,604,421 B1 8/2003 Li
6,609,049 B1 8/2003 Kane et al.
6,612,245 B2 9/2003 Kumar et al.
6,612,246 B2 9/2003 Kumar
6,615,118 B2 9/2003 Kumar
6,615,188 B1 9/2003 Breen et al.
6,631,322 B1 10/2003 Arthur et al.
6,634,112 B2 10/2003 Carr et al.
6,647,328 B2 11/2003 Walker
6,647,891 B2 11/2003 Holmes et al.
6,665,609 B1 12/2003 Franke et al.
6,668,217 B1 12/2003 Franke et al.
6,676,089 B1 1/2004 Katzer
6,681,160 B2 1/2004 Bidaud
6,691,022 B2 2/2004 Takemura et al.
6,694,231 B1 2/2004 Rezk
6,698,913 B2 3/2004 Yamamoto
6,701,064 B1 3/2004 De Haan et al.
6,712,045 B1 3/2004 Mccarthy, Jr.
6,725,782 B1 4/2004 Bloom et al.
6,728,515 B1 4/2004 Wooh
6,728,606 B2 4/2004 Kumar
6,728,625 B2 4/2004 Strubhar et al.
6,732,023 B2 5/2004 Sugita et al.
6,732,032 B1 5/2004 Banet et al.

(56) References Cited

U.S. PATENT DOCUMENTS 6,742,392 B2 6/2004 Gilmore et al.
6,748,303 B2 6/2004 Hawthorne
6,748,313 B2 6/2004 Li et al.
6,763,291 B1 7/2004 Houpt et al.
6,778,284 B2 8/2004 Casagrande
6,782,044 B1 8/2004 Wright et al.
6,789,005 B2 9/2004 Hawthorne
6,799,096 B1 9/2004 Franke et al.
6,804,621 B1 10/2004 Pedanckar
6,810,312 B2 10/2004 Jammu et al.
6,812,888 B2 11/2004 Drury et al.
6,814,050 B2 11/2004 Kishibata et al.
6,814,060 B1 11/2004 Solomons et al.
6,823,844 B2 11/2004 Steinbrenner et al.
6,833,554 B2 12/2004 Wooh
6,853,888 B2 2/2005 Kane et al.
6,853,890 B1 2/2005 Horst et al.
6,854,691 B2 2/2005 Kraeling et al.
6,863,246 B2 3/2005 Kane et al.
6,865,454 B2 3/2005 Kane et al.
6,893,262 B2 5/2005 Stockman
6,895,362 B2 5/2005 Davenport et al.
6,903,658 B2 6/2005 Kane et al.
6,904,110 B2 6/2005 Trans et al.
6,910,792 B2 6/2005 Takada et al.
6,915,191 B2 7/2005 Kane et al.
6,945,114 B2 9/2005 Kenderian et al.
6,947,830 B1 9/2005 Froloff et al.
6,948,837 B2 9/2005 Suzuki
6,951,132 B2 10/2005 Davenport et al.
6,953,272 B2 10/2005 Hayakawa et al.
6,957,131 B2 10/2005 Kane et al.
6,973,947 B2 12/2005 Penaloza et al.
6,976,324 B2 12/2005 Theurer et al.
6,980,894 B1 12/2005 Gordon et al.
6,996,461 B2 2/2006 Kane et al.
7,007,561 B1 3/2006 Otto et al.
7,023,539 B2 4/2006 Kowalski
7,031,823 B2 4/2006 Chatfield et al.
7,036,232 B2 5/2006 Casagrande
7,036,774 B2 5/2006 Kane et al.
7,047,130 B2 5/2006 Watanabe et al.
7,050,926 B2 5/2006 Theurer et al.
7,051,693 B2 5/2006 Tetsuno et al.
7,053,606 B2 5/2006 Buttle et al.
7,054,762 B2 5/2006 Pagano et al.
7,072,757 B2 7/2006 Adams et al.
7,081,824 B2 7/2006 Gilbert
7,082,881 B2 8/2006 Schneider et al.
7,082,924 B1 8/2006 Ruedin
7,096,171 B2 8/2006 Hawthorne et al.
7,131,403 B1 11/2006 Banga et al.
7,140,477 B2 11/2006 Engle et al.
7,152,330 B2 12/2006 Kleeberg
7,161,500 B2 1/2007 Alfredsson et al.
7,164,975 B2 1/2007 Bidaud
7,181,851 B2 2/2007 Theurer et al.
7,188,009 B2 3/2007 Hawthorne
7,197,932 B2 4/2007 Sakai et al.
7,200,536 B2 4/2007 Wynn
7,201,350 B2 4/2007 Sugita et al.
7,219,067 B1 5/2007 Mcmullen et al.
7,226,021 B1 6/2007 Anderson et al.
7,228,747 B2 6/2007 Pieper
7,234,449 B2 6/2007 Casablanca et al.
7,263,647 B2 8/2007 Bryant et al.
7,263,886 B2 9/2007 Jury
7,290,807 B2 11/2007 Kumar
7,296,770 B2 11/2007 Franke
7,305,885 B2 12/2007 Barshinger et al.
7,309,929 B2 12/2007 Donnelly et al.
7,312,607 B2 12/2007 Nygaard
7,337,766 B2 3/2008 Nakayama et al.
7,387,029 B2 6/2008 Cunningham
7,389,694 B1 6/2008 Hay et al.
7,392,117 B1 6/2008 Bilodeau et al.
7,394,553 B2 7/2008 Carr et al.
7,395,141 B1 7/2008 Seck et al.
7,403,296 B2 7/2008 Farritor et al.
7,416,262 B2 8/2008 Ring
7,463,348 B2 12/2008 Chung
7,497,201 B2 3/2009 Hollenbeck
7,502,670 B2 3/2009 Harrison
7,509,193 B2 3/2009 Kustosch
7,520,415 B2 4/2009 Kral et al.
7,523,893 B2 4/2009 Francis et al.
7,539,596 B2 5/2009 Zoll et al.
7,543,670 B2 6/2009 Tamai et al.
7,557,748 B1 7/2009 Zahm et al.
7,565,867 B2 7/2009 Donnelly et al.
7,575,201 B2 8/2009 Bartonek
7,659,972 B2 2/2010 Magnus et al.
7,667,611 B2 2/2010 Lindsey et al.
7,716,010 B2 5/2010 Pelletier
7,734,387 B1 6/2010 Young et al.
7,752,913 B2 7/2010 Heckel et al.
7,755,660 B2 7/2010 Nejikovsky et al.
7,770,847 B1 8/2010 Severson
7,778,747 B2 8/2010 Hawkins et al.
7,783,397 B2 8/2010 Peltz et al.
7,811,089 B2 10/2010 Bond
7,869,909 B2 1/2011 Harrison
7,872,736 B2 1/2011 Rogers et al.
7,882,742 B1 2/2011 Martens
7,895,135 B2 2/2011 Norris et al.
7,920,984 B2 4/2011 Farritor
7,937,246 B2 5/2011 Farritor et al.
7,938,370 B1 5/2011 Lechevin et al.
7,940,389 B2 5/2011 Rogers et al.
7,960,855 B2 6/2011 King et al.
8,020,446 B2 9/2011 Bestebreurtje
8,030,871 B1 10/2011 Young et al.
8,037,763 B2 10/2011 Brignac et al.
8,068,975 B2 11/2011 Jensen et al.
8,081,320 B2 12/2011 Villar et al.
8,125,219 B2 2/2012 Jungbluth et al.
8,126,601 B2 2/2012 Kapp et al.
8,150,568 B1 4/2012 Gray
8,154,227 B1 4/2012 Young et al.
8,155,811 B2 4/2012 Noffsinger et al.
8,157,218 B2 4/2012 Riley et al.
8,157,219 B2 4/2012 Ashraf et al.
8,160,832 B2 4/2012 Luo et al.
8,195,364 B2 6/2012 Norris et al.
8,264,330 B2 9/2012 Yeldell et al.
8,266,092 B2 9/2012 Kuhn et al.
8,305,567 B2 11/2012 Hesser et al.
8,428,798 B2 4/2013 Kull
8,521,345 B2 8/2013 Cooper et al.
8,532,842 B2 9/2013 Smith et al.
8,626,366 B2 1/2014 Noffsinger et al.
8,645,047 B2 2/2014 Daum et al.
8,655,518 B2 2/2014 Cooper et al.
8,655,519 B2 2/2014 Cooper et al.
8,682,514 B2 3/2014 Falk et al.
9,108,640 B2 8/2015 Jackson
9,889,869 B2 * 2/2018 Kull ..... B61L 27/0088
2001/0001131 A1 5/2001 Miller
2001/0019263 A1 9/2001 Kwun et al.
2001/0026321 A1 10/2001 Goto
2001/0045495 A1 11/2001 Olson et al.
2001/0047241 A1 11/2001 Khavakh et al.
2002/0010531 A1 1/2002 Hawthorne et al.
2002/0049520 A1 * 4/2002 Mays ..... B61L 15/0027 701/19
2002/0059075 A1 5/2002 Schick et al.
2002/0062819 A1 5/2002 Takahashi
2002/0065698 A1 5/2002 Schick et al.
2002/0072833 A1 6/2002 Gray
2002/0096081 A1 7/2002 Kraft
2002/0103585 A1 8/2002 Biess et al.
2002/0104779 A1 8/2002 Connor et al.
2002/0107618 A1 8/2002 Deguchi et al.
2002/0113170 A1 8/2002 Grappone

(56) References Cited

U.S. PATENT DOCUMENTS

2002/0148931 A1 10/2002 Anderson
2002/0157901 A1 10/2002 Kast et al.
2002/0174653 A1 11/2002 Uzkan
2002/0188397 A1 12/2002 Biess et al.
2002/0195086 A1 12/2002 Beck et al.
2003/0000499 A1 1/2003 Doelker et al.
2003/0010872 A1 1/2003 Lewin et al.
2003/0020469 A1 1/2003 Katragadda et al.
2003/0034423 A1 2/2003 Hess, Jr. et al.
2003/0038216 A1 2/2003 Holgate
2003/0055666 A1 3/2003 Roddy et al.
2003/0060968 A1 3/2003 MacPhail et al.
2003/0070492 A1 4/2003 Buttle et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0107548 A1 6/2003 Eun et al.
2003/0120400 A1 6/2003 Ahmed Baig et al.
2003/0128030 A1 7/2003 Hintze et al.
2003/0139909 A1 7/2003 Ozawa
2003/0158640 A1 8/2003 Pillar et al.
2003/0183729 A1 10/2003 Root et al.
2003/0187694 A1 10/2003 Rowen
2003/0213875 A1 11/2003 Hess, Jr. et al.
2003/0214417 A1 11/2003 Peitz et al.
2003/0222981 A1 12/2003 Kisak et al.
2003/0229097 A1 12/2003 Watkins et al.
2003/0229446 A1 12/2003 Boscamp et al.
2003/0233959 A1 12/2003 Kumar et al.
2003/0236598 A1 12/2003 Villarreal Antelo et al.
2004/0010432 A1 1/2004 Matheson et al.
2004/0024515 A1 2/2004 Troupe et al.
2004/0024518 A1 2/2004 Boley et al.
2004/0025849 A1 2/2004 West et al.
2004/0026574 A1 2/2004 Seifert
2004/0034556 A1 2/2004 Matheson et al.
2004/0038831 A1 2/2004 Eadie et al.
2004/0048620 A1 3/2004 Nakahara et al.
2004/0049339 A1 3/2004 Kober et al.
2004/0068359 A1 4/2004 Neiss et al.
2004/0073361 A1 4/2004 Tzamaloukas et al.
2004/0075280 A1 4/2004 Kumar et al.
2004/0095135 A1 5/2004 Nejikovsky et al.
2004/0098142 A1 6/2004 Warren et al.
2004/0107042 A1 6/2004 Seick
2004/0108814 A1 6/2004 Tsuda et al.
2004/0129289 A1 7/2004 Hafemann
2004/0129840 A1 7/2004 Horst
2004/0133315 A1 7/2004 Kumar et al.
2004/0143374 A1 7/2004 Horst et al.
2004/0153221 A1 8/2004 Kumar
2004/0167687 A1 8/2004 Kornick et al.
2004/0172175 A1 9/2004 Julich et al.
2004/0174121 A1 9/2004 Tsuda et al.
2004/0238693 A1 12/2004 Cole
2004/0243664 A1 12/2004 Horstemeyer
2004/0245410 A1 12/2004 Kisak et al.
2004/0249571 A1 12/2004 Blesener et al.
2005/0004723 A1 1/2005 Duggan et al.
2005/0007020 A1 1/2005 Tsuda et al.
2005/0045058 A1 3/2005 Donnelly et al.
2005/0055157 A1 3/2005 Scholl
2005/0055287 A1 3/2005 Schmidtberg et al.
2005/0065674 A1 3/2005 Houpt et al.
2005/0065711 A1 3/2005 Dahlgren et al.
2005/0076716 A1 4/2005 Turner
2005/0090978 A1 4/2005 Bathory et al.
2005/0096797 A1 5/2005 Matsubara et al.
2005/0099323 A1 5/2005 Hirose
2005/0107954 A1 5/2005 Nahla
2005/0109882 A1 5/2005 Armbruster et al.
2005/0120904 A1 6/2005 Kumar et al.
2005/0121005 A1 6/2005 Edwards
2005/0121971 A1 6/2005 Ring
2005/0171655 A1 8/2005 Flynn
2005/0171657 A1 8/2005 Kumar
2005/0186325 A1 8/2005 Luangthep
2005/0188745 A1 9/2005 Staphanos et al.
2005/0189815 A1 9/2005 Bryant
2005/0189886 A1 9/2005 Donnelly et al.
2005/0192720 A1 9/2005 Christie et al.
2005/0196737 A1 9/2005 Mann
2005/0205719 A1 9/2005 Hendrickson et al.
2005/0210304 A1 9/2005 Hartung et al.
2005/0229604 A1 10/2005 Chen
2005/0251299 A1 11/2005 Donnelly et al.
2005/0253397 A1 11/2005 Kumar et al.
2005/0285552 A1 12/2005 Grubba et al.
2005/0288832 A1 12/2005 Smith et al.
2006/0005736 A1 1/2006 Kumar
2006/0017911 A1 1/2006 Villar et al.
2006/0025903 A1 2/2006 Kumar
2006/0030978 A1 2/2006 Rajaram
2006/0047379 A1 3/2006 Schullian et al.
2006/0055175 A1 3/2006 Grinblat
2006/0060345 A1 3/2006 Flik et al.
2006/0076461 A1 4/2006 Derose et al.
2006/0085103 A1 4/2006 Smith, Jr. et al.
2006/0085363 A1 4/2006 Cheng et al.
2006/0086546 A1 4/2006 Hu et al.
2006/0098843 A1 5/2006 Chew
2006/0116789 A1 6/2006 Subramanian et al.
2006/0116795 A1 6/2006 Abe et al.
2006/0122737 A1 6/2006 Tani et al.
2006/0129289 A1 6/2006 Kumar et al.
2006/0138285 A1 6/2006 Oleski et al.
2006/0162973 A1 7/2006 Harris et al.
2006/0173596 A1 8/2006 Hohmann
2006/0178800 A1 8/2006 Chen et al.
2006/0187086 A1 8/2006 Quintus
2006/0212188 A1 9/2006 Kickbusch et al.
2006/0212189 A1 9/2006 Kickbusch et al.
2006/0219214 A1 10/2006 Okude et al.
2006/0225710 A1 10/2006 Taglialatela Scafati et al.
2006/0231066 A1 10/2006 Demura et al.
2006/0235584 A1 10/2006 Fregene et al.
2006/0235604 A1 10/2006 Taglialatela Scafati et al.
2006/0253233 A1 11/2006 Metzger
2006/0271291 A1 11/2006 Meyer
2006/0277906 A1 12/2006 Burk et al.
2006/0282199 A1 12/2006 Daum et al.
2007/0006831 A1 1/2007 Leone et al.
2007/0061053 A1 3/2007 Zeitzew
2007/0062476 A1 3/2007 Ota et al.
2007/0073466 A1 3/2007 Tamai et al.
2007/0078026 A1 4/2007 Holt et al.
2007/0093148 A1 4/2007 Gibbs et al.
2007/0108308 A1 5/2007 Keightley
2007/0112475 A1 5/2007 Koebler et al.
2007/0129852 A1 6/2007 Chen et al.
2007/0132463 A1 6/2007 Anderson
2007/0135988 A1 6/2007 Kidston et al.
2007/0137514 A1 6/2007 Kumar et al.
2007/0163352 A1 7/2007 Nielsen et al.
2007/0183039 A1 8/2007 Irvin
2007/0203203 A1 8/2007 Tao et al.
2007/0209619 A1 9/2007 Leone
2007/0217670 A1 9/2007 Bar Am
2007/0219681 A1 9/2007 Kumar et al.
2007/0219682 A1 9/2007 Kumar et al.
2007/0219683 A1 9/2007 Daum et al.
2007/0225878 A1 9/2007 Kumar et al.
2007/0233335 A1 10/2007 Kumar et al.
2007/0233364 A1 10/2007 Kumar et al.
2007/0236366 A1 10/2007 Gur et al.
2007/0241237 A1 10/2007 Foy et al.
2007/0250225 A1 10/2007 Nickles et al.
2007/0250255 A1 10/2007 Matekunas et al.
2007/0260367 A1 11/2007 Wills et al.
2007/0260369 A1 11/2007 Philp et al.
2007/0261648 A1 11/2007 Reckels et al.
2007/0274158 A1 11/2007 Agam et al.
2008/0004721 A1 1/2008 Huff et al.

(56) References Cited

U.S. PATENT DOCUMENTS

2008/0010571 A1 1/2008 Farnsworth et al.
2008/0041267 A1 2/2008 Denen et al.
2008/0065282 A1 3/2008 Daum et al.
2008/0091334 A1 4/2008 Carlson et al.
2008/0105791 A1 5/2008 Karg
2008/0109124 A1 5/2008 Daum et al.
2008/0110249 A1 5/2008 Degeorge et al.
2008/0125924 A1 5/2008 Daum et al.
2008/0128563 A1 6/2008 Kumar et al.
2008/0142645 A1 6/2008 Tomlinson et al.
2008/0147256 A1 6/2008 Liberatore
2008/0161984 A1 7/2008 Hrdlicka et al.
2008/0164078 A1 7/2008 Rhodes et al.
2008/0183345 A1 7/2008 Chandra et al.
2008/0183490 A1 7/2008 Martin et al.
2008/0201019 A1 8/2008 Kumar et al.
2008/0201028 A1 8/2008 Brooks et al.
2008/0201056 A1 8/2008 Moriya
2008/0201089 A1 8/2008 Diaz et al.
2008/0208393 A1 8/2008 Schricker
2008/0296441 A1 12/2008 Anderson et al.
2008/0312775 A1 12/2008 Kumar
2009/0044530 A1 2/2009 Gallagher et al.
2009/0063045 A1 3/2009 Figueroa et al.
2009/0076664 A1 3/2009 Mccabe et al.
2009/0078236 A1 3/2009 Gallagher et al.
2009/0132179 A1 5/2009 Fu et al.
2009/0140574 A1 6/2009 Gorman et al.
2009/0159046 A1 6/2009 Moriya
2009/0164104 A1 6/2009 Wermuth et al.
2009/0177345 A1 7/2009 Severinsky et al.
2009/0186325 A1 7/2009 Kumar
2009/0187291 A1 7/2009 Daum et al.
2009/0193899 A1 8/2009 Panetta et al.
2009/0198391 A1 8/2009 Kumar
2009/0205028 A1 8/2009 Smeets et al.
2009/0241909 A1 10/2009 Smith
2009/0248220 A1 10/2009 Ecton et al.
2009/0254239 A1 10/2009 Daum et al.
2009/0266166 A1 10/2009 Pagano
2009/0266943 A1 10/2009 Kumar et al.
2009/0282923 A1 11/2009 Havira
2009/0299555 A1 12/2009 Houpt et al.
2009/0319092 A1 12/2009 Piche
2010/0023190 A1 1/2010 Kumar et al.
2010/0023240 A1 1/2010 Haskara et al.
2010/0049384 A1 2/2010 Kraeling et al.
2010/0049408 A1 2/2010 Abadie et al.
2010/0084916 A1 4/2010 Kumar et al.
2010/0114404 A1 5/2010 Donnelly
2010/0130124 A1 5/2010 Teeter et al.
2010/0131130 A1 5/2010 Kalyanam et al.
2010/0152998 A1 6/2010 Schwarzmann
2010/0174427 A1 7/2010 Sivasubramaniam et al.
2010/0207620 A1 8/2010 Gies
2010/0235022 A1 9/2010 Siddappa et al.
2010/0262321 A1 10/2010 Daum et al.
2010/0312493 A1 12/2010 Purekar et al.
2010/0318247 A1 12/2010 Kumar
2010/0332058 A1 12/2010 Kane et al.
2011/0006167 A1 1/2011 Tolmei
2011/0029243 A1 2/2011 Gallagher et al.
2011/0035138 A1 2/2011 Kickbusch et al.
2011/0060486 A1 3/2011 Meltser et al.
2011/0093144 A1 4/2011 Goodermuth et al.
2011/0118899 A1 5/2011 Brooks et al.
2011/0199607 A1 8/2011 Kanellopoulos et al.
2011/0216996 A1 9/2011 Rogers
2011/0233293 A1 9/2011 Kral et al.
2011/0255077 A1 10/2011 Rogers
2011/0257869 A1 10/2011 Kumar et al.
2011/0276203 A1 11/2011 Hase
2011/0284700 A1 11/2011 Brand et al.
2011/0307113 A1 12/2011 Kumar et al.
2011/0313671 A1 12/2011 Nedilko et al.
2012/0022728 A1 1/2012 Hall et al.
2012/0108204 A1 5/2012 Schell et al.
2012/0108205 A1 5/2012 Schell et al.
2012/0108207 A1 5/2012 Schell et al.
2012/0135710 A1 5/2012 Schell et al.
2012/0197504 A1 8/2012 Sujan et al.
2012/0217351 A1 8/2012 Chadwick et al.
2012/0245766 A1 9/2012 Cooper et al.
2012/0245770 A1 9/2012 Yamamoto et al.
2012/0259531 A1 10/2012 Daum et al.
2012/0277940 A1 11/2012 Kumar et al.
2012/0290185 A1 11/2012 Cooper et al.
2012/0296545 A1 11/2012 Cooper et al.
2012/0316717 A1 12/2012 Daum et al.
2013/0015298 A1 1/2013 Cooper et al.
2013/0035811 A1 2/2013 Schroeck et al.
2013/0062474 A1 3/2013 Baldwin et al.
2013/0131898 A1 5/2013 Kumar et al.
2013/0131909 A1 5/2013 Cooper et al.
2013/0169037 A1 7/2013 Bieg et al.
2013/0171590 A1 7/2013 Kumar
2013/0173083 A1 7/2013 Cooper et al.
2013/0261837 A1 10/2013 Sharma et al.
2013/0261856 A1 10/2013 Sharma et al.
2013/0284859 A1 10/2013 Polivka et al.
2013/0317676 A1* 11/2013 Cooper ..... B61L 3/121 701/20
2013/0334373 A1 12/2013 Malone, Jr. et al.
2014/0094998 A1 4/2014 Cooper et al.
2014/0125356 A1 5/2014 Cooper et al.
2014/0129154 A1 5/2014 Cooper et al.
2014/0138493 A1 5/2014 Noffsinger et al.
2014/0156123 A1 6/2014 Cooper et al.
2014/0277824 A1 9/2014 Kemwein et al.
2014/0280899 A1 9/2014 Brewster, Jr. et al.
2015/0009331 A1 1/2015 Venkatraman
2015/0053827 A1 2/2015 Noffsinger et al.
2015/0070503 A1* 3/2015 Kraeling ..... H04N 5/23203 348/148
2015/0081214 A1* 3/2015 Cooper ..... B60L 3/10 701/523
2015/0183448 A1 7/2015 Cooper et al.

FOREIGN PATENT DOCUMENTS

CA 1065039 A 10/1979
CA 2192151 A1 8/1997
CA 2466540 A1 11/2004
CA 2627074 A1 5/2007
CH 642418 A5 4/1984
CN 1511744 A 7/2004
CN 1528631 A 9/2004
CN 1636814 A 7/2005
CN 1683914 A 10/2005
CN 1819942 A 8/2006
CN 1906074 A 1/2007
CN 1958363 A 5/2007
CN 101351373 A 1/2009
CN 101412377 A 4/2009
CN 102556118 B 6/2014
DE 1605862 A1 5/1971
DE 129761 A1 2/1978
DE 208324 A1 5/1984
DE 3538165 A1 4/1987
DE 255132 A1 3/1988
DE 4225800 C1 11/1993
DE 19645426 A1 5/1997
DE 19654960 A1 7/1998
DE 19731643 A1 9/1998
DE 19726542 A1 11/1998
DE 19830053 C1 11/1999
DE 19826764 A1 12/1999
DE 19935349 A1 2/2001
DE 19935352 A1 2/2001
DE 19935353 A1 2/2001
DE 10045921 A1 3/2002
DE 10226143 B4 2/2006
DE 102005051077 A1 4/2007
DE 202010006811 U1 7/2010

(56) References Cited

FOREIGN PATENT DOCUMENTS

| | | | |
|---|---|---|---|
| DE | 102010026433 | A1 | 1/2012 |
| DE | 102010045234 | A1 | 3/2012 |
| DE | 102013219763 | A1 | 8/2014 |
| EP | 88716 | A2 | 9/1983 |
| EP | 0114633 | A1 | 8/1984 |
| EP | 0341826 | A2 | 11/1989 |
| EP | 0445047 | A1 | 9/1991 |
| EP | 0467377 | A2 | 1/1992 |
| EP | 0485978 | A1 | 5/1992 |
| EP | 0539885 | A2 | 5/1993 |
| EP | 0554983 | A1 | 8/1993 |
| EP | 0594226 | A2 | 4/1994 |
| EP | 644098 | A2 | 3/1995 |
| EP | 719690 | A2 | 7/1996 |
| EP | 0755840 | A1 | 1/1997 |
| EP | 0958987 | A2 | 11/1999 |
| EP | 1034984 | A2 | 9/2000 |
| EP | 1143140 | A1 | 10/2001 |
| EP | 1253059 | A1 | 10/2002 |
| EP | 1293948 | A2 | 3/2003 |
| EP | 1297982 | A2 | 4/2003 |
| EP | 1348854 | A1 | 10/2003 |
| EP | 1466803 | A1 | 10/2004 |
| EP | 1562321 | A2 | 8/2005 |
| EP | 1564395 | A2 | 8/2005 |
| EP | 1566533 | A1 | 8/2005 |
| EP | 1754644 | A1 | 2/2007 |
| EP | 1816332 | A1 | 8/2007 |
| FR | 2129215 | A5 | 10/1972 |
| FR | 2558806 | A1 | 8/1985 |
| FR | 2767770 | A1 | 3/1999 |
| GB | 482625 | A | 4/1938 |
| GB | 1321053 | A | 6/1973 |
| GB | 1321054 | A | 6/1973 |
| GB | 2188464 | A | 9/1987 |
| GB | 2371121 | A | 7/2002 |
| GB | 2414816 | A | 12/2005 |
| JP | 52121192 | A | 10/1977 |
| JP | 63268405 | A | 11/1988 |
| JP | 11002558 | A | 4/1989 |
| JP | 03213459 | A | 9/1991 |
| JP | 0532733 | A | 2/1993 |
| JP | 561347 | A | 3/1993 |
| JP | 0577734 | A | 3/1993 |
| JP | 5238392 | A | 9/1993 |
| JP | 5278615 | A | 10/1993 |
| JP | 0628153 | A | 2/1994 |
| JP | 06108869 | A | 4/1994 |
| JP | 06153327 | A | 5/1994 |
| JP | 7132832 | A | 5/1995 |
| JP | 08198102 | A | 8/1996 |
| JP | 0976913 | A | 3/1997 |
| JP | 9193804 | A | 7/1997 |
| JP | 9200910 | A | 7/1997 |
| JP | 10274075 | A | 10/1998 |
| JP | 112558 | A | 1/1999 |
| JP | 2858529 | B2 | 2/1999 |
| JP | 2001065360 | A | 3/2001 |
| JP | 2002204507 | A | 7/2002 |
| JP | 2002249049 | A | 9/2002 |
| JP | 2002294609 | A | 10/2002 |
| JP | 2003095109 | A | 4/2003 |
| JP | 2004301080 | A | 10/2004 |
| JP | 2004328993 | A | 11/2004 |
| JP | 2005002802 | A | 1/2005 |
| JP | 2006219051 | A | 8/2006 |
| JP | 2006320139 | A | 11/2006 |
| JP | 2006327551 | A | 12/2006 |
| JP | 2008535871 | A | 9/2008 |
| JP | 2009095094 | A | 4/2009 |
| KZ | 386 | U | 8/2008 |
| RU | 2115140 | C1 | 7/1998 |
| RU | 2207279 | C1 | 6/2003 |
| RU | 2213669 | C1 | 10/2003 |
| RU | 2233011 | C2 | 7/2004 |
| RU | 2237589 | C1 | 10/2004 |
| RU | 2238860 | C1 | 10/2004 |
| RU | 2238869 | C1 | 10/2004 |
| RU | 2242392 | C2 | 12/2004 |
| RU | 2265539 | C2 | 12/2005 |
| RU | 2272731 | C2 | 3/2006 |
| RU | 2273567 | C1 | 4/2006 |
| RU | 2286279 | C2 | 10/2006 |
| RU | 2299144 | C2 | 5/2007 |
| RU | 2320498 | C1 | 3/2008 |
| RU | 83221 | U1 | 5/2009 |
| SU | 568241 | A1 | 12/1981 |
| WO | 9003622 | A1 | 4/1990 |
| WO | 9525053 | A1 | 9/1995 |
| WO | 199601431 | A1 | 1/1996 |
| WO | 9606766 | A1 | 3/1996 |
| WO | 1998058829 | A1 | 12/1998 |
| WO | 9914090 | A1 | 3/1999 |
| WO | 9960735 | A1 | 11/1999 |
| WO | 200009377 | A1 | 2/2000 |
| WO | 200186139 | A1 | 11/2001 |
| WO | 200230729 | A1 | 4/2002 |
| WO | 2002060738 | A1 | 8/2002 |
| WO | 03097424 | A1 | 11/2003 |
| WO | 2004023517 | A1 | 3/2004 |
| WO | 2004039621 | A1 | 5/2004 |
| WO | 2004051699 | A2 | 6/2004 |
| WO | 2004051700 | A2 | 6/2004 |
| WO | 2004052755 | A1 | 6/2004 |
| WO | 2004059446 | A2 | 7/2004 |
| WO | 2005028837 | A2 | 3/2005 |
| WO | 2006049252 | A1 | 5/2006 |
| WO | 2006065730 | A2 | 6/2006 |
| WO | 2006133306 | A1 | 12/2006 |
| WO | 2007027130 | A1 | 3/2007 |
| WO | 2007091270 | A2 | 8/2007 |
| WO | 2007110613 | A1 | 10/2007 |
| WO | 2007116123 | A1 | 10/2007 |
| WO | 2008012535 | A2 | 1/2008 |
| WO | 2008065032 | A1 | 6/2008 |
| WO | 2008073547 | A2 | 6/2008 |
| WO | 2008099177 | A1 | 8/2008 |
| WO | 2009087385 | A2 | 7/2009 |
| WO | 2009092218 | A1 | 7/2009 |
| WO | 2010039680 | A1 | 4/2010 |
| WO | 2010139489 | A1 | 12/2010 |
| WO | 2011146088 | A1 | 11/2011 |
| WO | 2012041978 | A2 | 4/2012 |
| WO | 2014193610 | A1 | 12/2014 |
| ZA | 200101708 | B | 8/2001 |

OTHER PUBLICATIONS

Unofficial English translation of Office Action issued in connection with related JP Application No. 2009-511134 dated Oct. 25, 2011.

Unofficial English translation of Office Action issued in connection with related RU Application No. 2008108985 dated Oct. 26, 2011

Unofficial English translation of Office Action issued in connection with related RU Application No. 2008108972 dated Oct. 28, 2011.

Notice of Allowance issued in connection with related AU Application No. 2007333518 dated Nov. 14, 2011.

Final Rejection towards related U.S. Appl. No. 12/061,486 dated Nov. 16, 2011.

Notice of Allowance issued in connection with related U.S. Appl. No. 12/047,427 dated Dec. 30, 2011.

Weart, "Maintenance of Way: Track inspection technology", pp. 1-7, Dec. 2011.

Pan et al., "Full process control strategy of fuel based on water-coal ratio of ultra supercritical units", Electronics, communications and Control (ICECC), IEEE International Conference, Guangzhou, China, pp. 3750-3753, 2011.

Non-Final Rejection towards related U.S. Appl. No. 12/126,858 dated Jan. 18, 2012.

Non-Final Rejection towards related U.S. Appl. No. 12/061,444 dated Jan. 31, 2012.

Non-Final Rejection towards related U.S. Appl. No. 11/622,136 dated Feb. 27, 2012.

(56) References Cited

OTHER PUBLICATIONS

Shanthini et al., "Electromagnetic System for Railroad Track Crack Detection", British Journal of Science, vol. No. 4, Issue No. 1, pp. 49-56, Feb. 2012.
Unofficial English translation of Office Action issued in connection with related JP Application No. 2009-530500 dated Apr. 3, 2012.
Non-Final Rejection towards related U.S. Appl. No. 12/061,486 dated Apr. 4, 2012.
Non-Final Rejection towards related U.S. Appl. No. 12/484,278 dated Apr. 5, 2012.
Notice of Allowance issued in connection with related AU Application No. 2008302642 dated May 10, 2012.
Final Rejection towards related U.S. Appl. No. 12/128,249 dated May 15, 2012.
Notice of Allowance issued in connection with related U.S. Appl. No. 12/126,858 dated Jun. 18, 2012.
Unofficial English translation of Notice of Allowance issued in connection with related RU Application No. 2008124977 dated Jun. 22, 2012.
Unofficial English translation of Notice of Allowance issued in connection with related RU Application No. 2008110502 dated Jul. 3, 2012.
Unofficial English translation of Office Action issued in connection with related CN Application No. 200980112545.9 dated Sep. 11, 2012.
Non-Final Rejection towards related U.S. Appl. No. 12/052,816 dated Sep. 12, 2012.
Final Rejection towards related U.S. Appl. No. 12/484,278 dated Sep. 20, 2012.
Non-Final Rejection towards related U.S. Appl. No. 12/556,334 dated Sep. 27, 2012.
Unofficial English translation of Office Action issued in connection with related JP Application No. 2009-540342 dated Oct. 2, 2012.
Non-Final Rejection towards related application 11/669,364 dated Oct. 17, 2012.
Final Rejection towards related U.S. Appl. No. 12/052,000 dated Oct. 24, 2012.
Unofficial English translation of Office Action issued in connection with related CN Application No. 200780001185.6 dated Oct. 29, 2012.
Unofficial English translation of Office Action issued in connection with related CN Application No. 201010584148.6 dated Oct. 30, 2012.
Final Rejection towards related U.S. Appl. No. 12/027,408 dated Oct. 31, 2012.
Unofficial English translation of Notice of Allowance issued in connection with related RU Application No. 2008125850 dated Oct. 31, 2012.
Non-Final Rejection towards related U.S. Appl. No. 12/061,486 dated Nov. 2, 2012.
Unofficial English translation of Office Action issued in connection with related CN Application No. 201010584140.X dated Nov. 21, 2012.
Notice of Allowance issued in connection with related U.S. Appl. No. 12/484,278 dated Nov. 27, 2012.
Unofficial English translation of Notice of Allowance issued in connection with related RU Application No. 2008108985 dated Dec. 4, 2012.
Office Action issued in connection with related AU Application No. 2010260419 dated Dec. 6, 2012.
Non-Final Rejection towards related U.S. Appl. No. 13/595,474 dated Dec. 11, 2012.
Unofficial English translation of Notice of Allowance issued in connection with related RU Application No. 2007126476 dated Dec. 21, 2012.
Unofficial English translation of Office Action issued in connection with related CN Application No. 200880108755.6 dated Dec. 26, 2012.
Non-Final Rejection towards related U.S. Appl. No. 12/270,160 dated Dec. 31, 2012.
Unofficial English translation of Office Action issued in connection with related JP Application No. 2009-530500 dated Jan. 8, 2013.
Unofficial English translation of Office Action issued in connection with related JP Application No. 2009-540344 dated Jan. 22, 2013.
Final Rejection towards related U.S. Appl. No. 12/061,444 dated Jan. 31, 2013.
International Invitation to Pay Additional Fees issued in connection with related PCT Application No. PCT/US2012/044367 dated Feb. 1, 2013.
Kun-Peng et al., "Design of transmission system of real-time broken rail detection", Journal of Railway Science and Engineering, vol. No. 10, Issue No. 1, Feb. 2013.
Office Action issued in connection with related AU Application No. 2007253963 dated Mar. 12, 2011.
Final Rejection towards related U.S. Appl. No. 11/622,136 dated Mar. 13, 2013.
Non-Final Rejection towards related U.S. Appl. No. 13/175,284 dated Mar. 18, 2013.
Unofficial English translation of Office Action issued in connection with related MX Application No. MX/a/2012/007335 dated Mar. 21, 2013.
European Search Report and Written Opinion issued in connection with related EP Application No. 161701511 dated Oct. 21, 2016.
Notice of Allowance issued in connection with related U.S. Appl. No. 14/679,217 dated Oct. 24, 2016.
Notice of Allowance issued in connection with related U.S. Appl. No. 14/457,304 dated Oct. 28, 2016.
European Search Report and Written Opinion issued in connection with related EP Application No. 13856206.1 dated Nov. 11, 2016.
Unofficial English translation of Office Action issued in connection with related CN Application No. 201210356915.7 dated Dec. 2, 2016.
Notice of Allowance issued in connection with related U.S. Appl. No. 14/016,310 dated Aug. 18, 2014.
Final Rejection towards related U.S. Appl. No. 13/778,428 dated Sep. 9, 2014.
Non-Final Rejection towards related U.S. Appl. No. 13/618,970 dated Sep. 9, 2014.
Non-Final Rejection towards related U.S. Appl. No. 14/095,373 dated Sep. 16, 2014.
Non-Final Rejection towards related U.S. Appl. No. 13/565,571 dated Oct. 2, 2014.
Unofficial English translation of Notice of allowance issued in connection with related KZ Application No. 2013/1558.1 dated Nov. 6, 2014.
Notice of Allowance issued in connection with related U.S. Appl. No. 13/618,970 dated Nov. 19, 2014.
Notice of Allowance issued in connection with related AU Application No. 2010292820 dated Nov. 19, 2014.
Maldonado et al., "Autonomous Broken Rail Department of Transportation, Federal Railroad Detection Technology for Use on Revenue Service Trains", U.S. Administration, pp. 1-4, Dec. 2014.
Non-Final Rejection towards related U.S. Appl. No. 13/591,561 dated Feb. 13, 2015.
Non-Final Rejection towards related U.S. Appl. No. 13/171,712 dated Mar. 10, 2015.
Non-Final Rejection towards related U.S. Appl. No. 14/489,126 dated Apr. 9, 2015.
Non-Final Rejection towards related U.S. Appl. No. 11/669,364 dated Apr. 23, 2015.
Notice of Allowance issued in connection with related U.S. Appl. No. 13/653,440 dated Apr. 30, 2015.
Ridgetop Group, "Ridgetop Group Announces New Products for Rail Safety Improvements", pp. 1-2, May 18, 2015.
Final Rejection towards related U.S. Appl. No. 13/591,561 dated Jun. 11, 2015.
Office Action issued in connection with related JP Application No. 2012-034736 dated Jun. 16, 2015.
Non-Final Rejection towards related U.S. Appl. No. 14/491,339 dated Jun. 17, 2015.
Non-Final Rejection towards related U.S. Appl. No. 14/221,624 dated Jun. 19, 2015.

(56) References Cited

OTHER PUBLICATIONS

Notice of Allowance issued in connection with related U.S. Appl. No. 14/489,126 dated Jun. 24, 2015.
Notice of Allowance issued in connection with related U.S. Appl. No. 11/669,364 dated Sep. 17, 2015.
Non-Final Rejection towards related U.S. Appl. No. 14/527,246 dated Sep. 22, 2015.
Final Rejection towards related U.S. Appl. No. 14/221,624 dated Oct. 5, 2015.
Non-Final Rejection towards related U.S. Appl. No. 13/939,326 dated Oct. 9, 2015.
Office Action issued in connection with related EP Application No. 11187312.1 dated Oct. 15, 2015.
Non-Final Rejection towards related U.S. Appl. No. 14/457,304 dated Oct. 22, 2015.
Sperry, "Sperry B-Scan Single Rail Walking Sticks", Informational pamphlet, Oct. 26, 2015.
Non-Final Rejection towards related U.S. Appl. No. 14/657,233 dated Nov. 18, 2015.
Non-Final Rejection towards related U.S. Appl. No. 14/679,217 dated Dec. 17, 2015.
Non-Final Rejection towards related U.S. Appl. No. 14/696,124 dated Dec. 23, 2015.
Eurasia Search Report and Written Opinion issued in connection with related EA Application No. 201591274 dated Jan. 21, 2016.
Unofficial English translation of Office Action issued in connection with related CN Application No. 201380071077.1 dated Feb. 6, 2016.
Notice of Allowance issued in connection with related U.S. Appl. No. 14/527,246 dated Feb. 23, 2016.
Office Action issued in connection with related AU Application No. 2015200168 dated Mar. 2, 2016.
Notice of Allowance issued in connection with related U.S. Appl. No. 13/591,561 dated Mar. 3, 2016.
Unofficial English translation of Office Action issued in connection with related RU Application No. 2012124894 dated Mar. 9, 2016.
Unofficial English translation of Office Action issued in connection with related CN Application No. 201310220043.6 dated Mar. 14, 2016.
Eurasia Search Report and Written Opinion issued in connection with related EA Application No. 201591504 dated Apr. 6, 2016.
Final Rejection towards related U.S. Appl. No. 14/679,217 dated Apr. 15, 2016.
Non-Final Rejection towards related U.S. Appl. No. 14/457,304 dated May 5, 2016.
Non-Final Rejection towards related U.S. Appl. No. 14/637,513 dated May 19, 2016.
Office Action issued in connection with related EP Application No. 08832181.5 dated Jun. 14, 2016.
International Search Report and Written Opinion issued in connection with corresponding PCT Application No. PCT/US2016/021925 dated Jun. 23, 2016.
Non-Final Rejection towards related U.S. Appl. No. 14/933,659 dated Jun. 30, 2016.
Office Action issued in connection with related AU Application No. 2013216630 dated Aug. 4, 2016.
Unofficial English translation of Notice of Allowance issued in connection with related RU Application No. 2012124894 dated Aug. 5, 2016.
Office Action issued in connection with related AU Application No. 2013299945 dated Aug. 8, 2016.
International Search Report and Written Opinion issued in connection with related PCT Application No. PCT/US2016/031444 dated Aug. 24, 2016.
Non-Final Rejection towards related U.S. Appl. No. 14/657,233 dated Sep. 7, 2016.
Office Action issued in connection with related AU Application No. 2013299501 dated Oct. 7, 2016.
Unofficial English translation of Notice of Allowance issued in connection with related RU Application No. 2008124977 dated Jul. 3, 2012.
Non-Final Rejection towards related U.S. Appl. No. 11/669,364 dated Oct. 17, 2012.
Office Action issued in connection with related AU Application No. 2010292820 dated Mar. 26, 2013.
Notice of Allowance issued in connection with related U.S. Appl. No. 13/529,783 dated Mar. 29, 2013.
Notice of Allowance issued in connection with related U.S. Appl. No. 12/556,334 dated Apr. 3, 2013.
Non-Final Rejection towards related U.S. Appl. No. 13/587,966 dated Apr. 5, 2013.
International Search Report and Written Opinion issued in connection with related PCT Application No. PCT/US2012/044367 dated Apr. 9, 2013.
Final Rejection towards related U.S. Appl. No. 11/831,492 dated Apr. 9, 2013.
Non-Final Rejection towards related U.S. Appl. No. 12/365,359 dated Apr. 11, 2013.
Office Action issued in connection with related AU Application No. 2013202194 dated Apr. 17, 2013.
Non-Final Rejection towards related U.S. Appl. No. 12/027,408 dated Apr. 23, 2013.
Unofficial English translation of Office Action issued in connection with related JP Application No. 2012-034736 dated May 14, 2013.
Notice of Allowance issued in connection with related U.S. Appl. No. 12/605,498 dated May 21, 2013.
Non-Final Rejection towards related U.S. Appl. No. 13/171,712 dated May 22, 2013.
Unofficial English translation of Notice of Allowance issued in connection with related RU Application No. 2008109249 dated May 29, 2013.
Notice of Allowance issued in connection with related U.S. Appl. No. 13/175,284 dated Jul. 8, 2013.
Hocking, "Rail Inspection", The Eddy Current Solution, pp. 1-17, Jul. 10, 2013.
Popov, "Automated Ultrasonic Inspection of Rails", pp. 1-5, Jul. 10, 2013.
Sperry, "Sperry B-Scan Dual Rail Inspection System", Sperry Rail Service, for superior technology, training, and reporting, the solution is Sperry, Jul. 10, 2013.
Non-Final Rejection towards related U.S. Appl. No. 12/061,444 dated Aug. 1, 2013.
Non-Final Rejection towards related U.S. Appl. No. 11/831,492 dated Aug. 6, 2013.
Non-Final Rejection towards related U.S. Appl. No. 13/739,133 dated Aug. 28, 2013.
Non-Final Rejection towards related U.S. Appl. No. 13/488,652 dated Sep. 9, 2013.
Non-Final Rejection towards related U.S. Appl. No. 13/344,331 dated Sep. 11, 2013.
Non-Final Rejection towards related U.S. Appl. No. 11/622,136 dated Sep. 12, 2013.
European Search Report and Written Opinion issued in connection with related EP Application No. 11187312.1 dated Oct. 23, 2013.
Notice of Allowance issued in connection with related U.S. Appl. No. 11/831,492 dated Oct. 31, 2011.
Final Rejection towards related U.S. Appl. No. 12/270,160 dated Oct. 31, 2013.
Notice of Allowance issued in connection with related AU Application No. 2010260419 dated Nov. 25, 2013.
Notice of Allowance issued in connection with related U.S. Appl. No. 13/739,133 dated Dec. 11, 2013.
Non-Final Rejection towards related U.S. Appl. No. 13/954,096 dated Dec. 24, 2013.
Zhang et al., "Train Detection by Magnetic Field Sensing", Sensors and Materials, vol. No. 25, Issue No. 6, pp. 423-436, 2013.
International Invitation to Pay Additional Fees issued in connection with related PCT Application No. PCT/US2013/054284 dated Jan. 20, 2014.
Office Action issued in connection with related EP Application No. 07716804.5 dated Jan. 21, 2014.

(56) References Cited

OTHER PUBLICATIONS

Notice of Allowance issued in connection with related U.S. Appl. No. 13/344,331 dated Jan. 23, 2014.
Notice of Allowance issued in connection with related U.S. Appl. No. 12/365,359 dated Jan. 28, 2014.
International Search Report and Written Opinion issued in connection with related PCT Application No. PCT/US2013/054300 dated Feb. 10, 2014.
Non-Final Rejection towards related U.S. Appl. No. 13/778,428 dated Feb. 25, 2014.
International Search Report and Written Opinion issued in connection with related PCT Application No. PCT/US2013/071237 dated Feb. 27, 2014.
Non-Final Rejection towards related U.S. Appl. No. 13/653,440 dated Mar. 19, 2014.
Notice of Allowance issued in connection with related U.S. Appl. No. 11/622,136 dated Mar. 27, 2014.
International Search Report and Written Opinion issued in connection with related PCT Application No. PCT/US2013/054284 dated Apr. 1, 2014.
International Invitation to Pay Additional Fees issued in connection with related PCT Application No. PCT/US2013/053124 dated Apr. 2, 2014.
Non-Final Rejection towards related U.S. Appl. No. 13/840,656 dated Apr. 16, 2014.
Non-Final Rejection towards related U.S. Appl. No. 14/016,310 dated Apr. 22, 2014.
Unofficial English translation of Office Action issued in connection with related CN Application No. 201210161080.X dated Apr. 29, 2014.
Non-Final Rejection towards related U.S. Appl. No. 13/171,712 dated May 8, 2014.
Knight, "10-4, Good Computer:Automated System Lets Trucks Convoy as One", MIT Technology Review, May 28, 2014.
International Search Report and Written Opinion issued in connection with related PCT Application No. PCT/US2013/053128 dated Jun. 23, 2014.
Notice of Allowance issued in connection with related U.S. Appl. No. 13/545,271 dated Jun. 26, 2014.
International Search Report and Written Opinion issued in connection with related PCT Application No. PCT/US2013/053124 dated Jul. 4, 2014.
Notice of Allowance issued in connection with related U.S. Appl. No. 13/595,474 dated Aug. 5, 2014.
Office Action issued in connection with related AU Application No. 2010292820 dated Mar. 26, 2011.
Sperry, reporting, "Sperry B-Scan Dual Rail Inspection System", Sperry Rail Service, For superior technology, training, and the solution is Sperry, Jul. 10, 2013.
Krevitt, "Remote Maintenance Techniques Proposed for the 200-BEV Accelerator", IEEE Transactions on Nuclear Science, vol. No. 14, Issue No. 3, pp. 997-1003, Jun. 1967.
Kiersztyn et al., "Evaluation of Locomotive Cable Insulation Life Under Varying Temperature Loading", IEEE Transactions on Industry Applications, vol. No. IA-21, Issue No. 4, pp. 882-888, Jul./Aug. 1985.
Hoyt et al., "Assessing the effects of several variables on freight train fuel consumption and performance using a train performance simulator", Transportation Research, vol. No. 24A, Issue No. 2, pp. 99-112, Jan. 1, 1990.
Grizzle et al., "Improved Cylinder Air Charge Estimation for Transient Air Fuel Ratio Control", Proceedings of the American Control Conference, Maryland, vol. No. 2, pp. 1568-1573, Jun. 29, 1994.
Bonissone et al., "Genetic algorithms for automated tuning of fuzzy controllers: A transportation application", Proceedings of the Fifth IEEE International Conference on Fuzzy Systems, Schenectady, NY, USA, vol. No. 1, pp. 574-680, 1996.
Ehsani et al., "Application of electrically peaking hybrid (ELPH) propulsion system to a full-size passenger car with simulated design verification", IEEE Transactions on Vehicular Technology, vol. No. 48, Issue No. 6, pp. 1779-1787, Nov. 1999.
He et al., "On-line Parameter Identification for Freight Train Systems", Aug. 29, 2000.
Franke et al., "An algorithm for the optimal control of the driving of trains", Proceedings of the 39th IEEE Conference on Decision and Control, Sydney Australia, pp. 2123-2127, Dec. 2000.
Dick et al., "Predicting the Occurrence of Broken Rails: A Quantitative Approach", In Proceedings of the American railway engineering and maintenance of way association annual conference, TX, USA, 2000.
Rose et al., "Application and potential of guided wave rail inspection", Defect Detection in Rail, Insight, vol. No. 44, Issue No. 6, pp. 353-358, Jun. 2002.
Aharoni et al., "A Novel high-speed rail inspection system", vol. No. 7, Issue No. 10, pp. 1-8, Oct. 2002.
Coleman, "A System for long haul Optimal Driver Advice", Session 5b: Capacity Planning & Train Scheduling, pp. 5.61-5.69, 2003.
Dick et al., "Multivariate statistical Model for Predicting Occurrence and Location of Broken Rails", Transportation Research Record: Journal of the Transportation Research Board, pp. 48-55, 2003.
Bosch, "Technology explained: the Common Rail diesel injection system", May 2004.
Turner, "Feasibility of Locomotive-Mounted Broken Rail Detection", Final Report for High-Speed Rail IDEA Project 38, IDEA, Transportation Research Board of the National Academies, Jun. 2004.
Hou et al., "A Rail Damage Detection and Measurement System Using Neural Networks", IEEE International conference on Computational Intelligence for Measurement Systems and Applications, Cimsa, Boston, MA, USA, pp. 1-9, Jul. 14-16, 2004.
Chan et al., "Trip Optimizer System Description (Rev. 1.1)", Trip Optimizer for Freight Trains Functional Description, pp. 1-24, Nov. 16, 2005.
Non-Final Rejection towards related U.S. Appl. No. 10/736,089 dated Feb. 13, 2006.
Ditmeyer, "Network Centric Railroading Utilizing Intelligent Railroad Systems", World Bank Transport Forum Rail Transport for Development, pp. 1-21, Mar. 31, 2006.
Brawner et al., "Magnetometer Sensor Feasibility for Railroad and Highway Equipment Detection", Innovations Deserving Exploratory Analysis Programs, HSR IDEA Program Final Report, pp. 1-27, Jun. 24, 2006.
Innotrack, "D4.4.1—Rail Inspection Technologies", Innovative Track Systems, pp. 1-42, Sep. 1, 2006.
Chen et al., "Fault Detection and Diagnosis for Railway Track Circuits Using Neuro-Fuzzy Systems", Control Engineering Practice, vol. No. 16, pp. 585-596, May 2008.
Non-Final Rejection towards related U.S. Appl. No. 11/858,345 dated Jun. 20, 2008.
Ho et al., "Signature Analysis on Wheel-Rail Interaction for Rail Defect Detection", Railway Condition Monitoring, 4th IET International Conference, Hong Kong, pp. 1-6, Jun. 2008.
Non-Final Rejection towards related U.S. Appl. No. 11/858,345 dated Nov. 19, 2008.
Final Rejection towards related U.S. Appl. No. 10/736,089 dated Dec. 12, 2008.
Unofficial English translation of Notice of Allowance issued in connection with related RU Application No. 2006125429 dated Dec. 22, 2008.
International Search Report and Written Opinion issued in connection with related PCT Application No. PCT/US2008/071958 dated Dec. 30, 2008.
Schafer II, "Effect of Train Length on Railroad Accidents and a Quantitative Analysis of Factors Affecting Broken Rails", 2008.
Non-Final Rejection towards related U.S. Appl. No. 11/858,345 dated Mar. 6, 2009.
Ghanbari et al., "Artificial Neural Networks and regression approaches comparison for forecasting Iran's annual electricity load", Power Engineering, Energy and Electrical Drives, POWERENG, pp. 675-679, Mar. 18-20, 2009.

(56) References Cited

OTHER PUBLICATIONS

Unofficial English translation of Office Action issued in connection with related CN Application No. 200480040639.7 dated Apr. 17, 2009.
Xin-Yu et al., "The Research on the Mechanism of Limiting Speed Pick-Up and Set-Out Train on Railway Transportation Capacity Loss", Second International Conference on Intelligent Computation Technology and Automation, Changsha, China, vol. No. 3, pp. 830-833, 2009.
Patra et al., "Availability Analysis of Railway Track Circuits", Proceedings of the Institution of Mechanical Engineers, Part F: Journal of Rail and Rapid Transit, vol. No. 224, Issue No. 3, pp. 169-177, May 1, 2010.
Office Action issued in connection with related AU Application No. 2007333518 dated Aug. 9, 2010.
Non-Final Rejection towards related U.S. Appl. No. 10/736,089 dated Sep. 2, 2010.
Xiaogang et al., "The Research and Application of 1089 t/h Circulating Fluidized Bed Unit Coordinate Control System", International Conference on E-Product E-Service and E-Entertainment (ICEEE), China, 2010.
Xun et al., "The analysis of GSM-R redundant network and reliability models on high-speed railway", International Conference on Electronics and Information Engineering (ICEIE), Beijing, China, vol. No. 2, pp. V2-154-V2-158, 2010.
International Search Report and Written Opinion issued in connection with related PCT Application No. PCT/US2010/048856 dated Feb. 8, 2011.
International Invitation to Pay Additional Fees issued in connection with related PCT Application No. PCT/US2010/047251 dated Mar. 4, 2011.
Unofficial English translation of Office Action issued in connection with related RU Application No. 2008110502 dated Mar. 10, 2011.
Non-Final Rejection towards related U.S. Appl. No. 11/765,443 dated Mar. 16, 2011.
Unofficial English translation of Office Action issued in connection with related RU Application No. 2007126476 dated Apr. 11, 2011.
Unofficial English translation of Office Action issued in connection with related RU Application No. 2010115501 dated May 26, 2011.
Unofficial English translation of Office Action issued in connection with related RU Application No. 2008109009 dated Aug. 23, 2011.
Non-Final Rejection towards related U.S. Appl. No. 12/027,408 dated Sep. 13, 2011.
International Search Report and Written Opinion issued in connection with related PCT Application No. PCT/US2010/045402 dated Sep. 26, 2011.
Non-Final Rejection towards related U.S. Appl. No. 12/270,160 dated Sep. 28, 2011.
Office Action issued in connection with related AU Application No. 2008302642 dated Sep. 29, 2011.
Unofficial English translation of Office Action issued in connection with related RU Application No. 2008125850 dated Sep. 29, 2011.
Hooper., "Reducing Rail Costs Through Innovative Methods", Railway Track and Structures, pp. 14-17, Jul. 1993.
Grabs., "Conflict Detection and Resolution for Disposable Tasks in Company Centers", Conversion in ESTW/Automation of the Disposition, Issue No. 05, pp. 254-258, Jul. 1995.
Chiang et al., "Cycle Detection in Repair-Based Railway Scheduling System," Proceedings of the 1996 IEEE International Conference on Robotics and Automation Minneapolis, New York, USA, vol. No. 3, pp. 2517-2522, Apr. 22, 1996.
Cheng., "Hybrid Simulation for Resolving Resource Conflicts in Train Traffic Rescheduling", Computers in Industry, vol. No. 35, Issue No. 3, pp. 233-246, Apr. 1, 1998.
Razouqi et al., "Rynsord: A Novel, Decentralized Algorithm for Railway Networks with 'Soft Reservation'" , VTC 98, 48TH IEEE Ottawa, Canada, vol. No. 03, pp. 2585-2589, May 18-21, 1998.
Cheng et al., "Algorithms on Optimal Driving Strategies for Train Control Problem", Proceedings of the 3rd World Congress on Intelligent Control and Automation, pp. 3523-3527, Jun. 28-Jul. 2, 2000.
Salasoo., "Heavy Vehicle Systems Optimization Program: FY 2004 Annual Report" Section VIIIA. "21st Century Locomotive Technology" pp. 156-163, 2004.
DOE, "21st Century Locomotive Technology-Quarterly Technical Status Report 6", Report No. DOE-AL68284-TSR06, pp. 1-10, Apr. to Jun. 2004.
DOE, "21st Century Locomotive Technology, Quarterly Technical Status Report 11", Report No. DOE-AL68284- TSR11, pp. 1-12, Jul. 2005 to Sep. 2005.
King et al., "DOE Heavy Vehicle Systems Optimization (peer review): 21st Century Locomotive Technology (Locomotive System Tasks)", 21st Century Locomotive Technology, pp. 1-20, Apr. 2006.
European Search Report and Opinion issued in Connection with Related EP Application No. 16186434.3 dated Jan. 17, 2017.
Non-Final Rejection towards U.S. Appl. No. 14/922,787 dated Oct. 26, 2018.
Final Rejection towards U.S. Appl. No. 14/922,787 dated Jan. 8, 2019.

* cited by examiner

VEHICLE CONTROL SYSTEM AND METHOD

CROSS-REFERENCE TO RELATED APPLICATIONS

This application claims priority to U.S. Provisional Application No. 62/134,518, which was filed on 17 Mar. 2015. This application is also a continuation-in-part of U.S. application Ser. No. 14/922,787, filed 26 Oct. 2015, which claims priority to U.S. Provisional Application No. 62/134,518. U.S. application Ser. No. 14/922,787 also is a continuation-in-part of U.S. application Ser. No. 14/155,454, filed 15 Jan. 2014 (the "'454 application"), and is a continuation-in-part of U.S. application Ser. No. 12/573,141, filed 4 Oct. 2009 (the "'141 application"). The '454 application is a continuation of International Application No. PCT/US13/54284, which was filed on 9 Aug. 2013, and claims priority to U.S. Provisional Application No. 61/681,843, which was filed on 10 Aug. 2012, to U.S. Provisional Application No. 61/729,188, which was filed on 21 Nov. 2012, to U.S. Provisional Application No. 61/860,469, which was filed on 31 Jul. 2013, and to U.S. Provisional Application No. 61/860,496, which was filed on 31 Jul. 2013. The '141 application is a continuation-in-part of U.S. application Ser. No. 11/385,354, which was filed on 20 Mar. 2006. The entire disclosures of these applications are incorporated herein by reference.

FIELD

Embodiments of the subject matter described herein relate to systems and methods for vehicle control.

BACKGROUND

Vehicle systems, such as automobiles, mining equipment, rail vehicles, over-the-road truck fleets, and the like, may be operated, at least in part, by vehicle control systems. These vehicle control systems may perform under the manual instruction of an operator, may perform partly on manual input that is supplemented with some predetermined level of environmental awareness (such as anti-lock brakes that engage when a tire loses traction), or may perform entirely autonomously. Further, the vehicles may switch back and forth from one operating mode to another.

The vehicle system may not be used efficiently if the path over which it travels is in disrepair. For example, a train (including both a locomotive and a series of rail cars) may derail if the rails are not within designated specifications. Railroads may experience many derailments per year. In addition to the repair work to the rails, the resulting costs include network congestion, idled assets, lost merchandise, and the like. At least some derailments may be caused by, at least in part, faults in the track, bridge, or signal and in the mechanical aspects of the rail cars. Contributing aspects to derailments may include damaged or broken rails and wheels.

To reduce or prevent derailments, it has been prudent to conduct a periodic visual inspection of the track and of rail cars while in rail yards. Additionally, technology has been introduced that uses ultrasonic detection and lasers that may be mounted on hi-rail vehicles, track-geometry test cars, and wayside detectors (every 24 kilometers to 483 kilometers apart) that monitor freight car bearings, wheel impacts, dragging equipment, and hot wheels. This approach relies on the ability to maintain the track to be within tolerances so that operating a vehicle system on that track can be done in a consistent manner.

Various freight movers have introduced the use of unmanned vehicle ("drone") technology to inspect right of ways or routes. These drones are equipped with at least visible light cameras, but may be equipped with more advanced LIDAR systems if certain technical challenges are overcome. The image payload is delivered to human reviewers for determination of the route status. It may be desirable to have a system that differs from those that are currently available.

BRIEF DESCRIPTION

In one embodiment of the subject matter described herein, a system is provided that includes a controller and route examination equipment. The route examination equipment obtains a route parameter indicative of a condition of a route over which a vehicle system travels. The controller receives the route parameter, and examines the route parameter to determine the condition of the route. The controller can control at least one operational aspect of the vehicle system in response to the determined condition of the route.

In one aspect, the route examination equipment includes one or both of a stationary wayside unit and a mobile route inspection unit. And, can combine the inspection information from multiple sources so as to predict the route condition for a particular route segment at a particular point in time. When the vehicle system is about to enter that segment, the controller can determine, based on the predicted condition of the route segment, the status of the vehicle system, and other factors, a speed ceiling for the vehicle system such that below that speed ceiling the possibility of a undesirable event (e.g., a crash or a derailment) is below a determined confidence threshold level.

In one embodiment of the subject matter described herein, a method includes obtaining two or more route parameters indicative of a condition of a segment of a route over which a vehicle system travels. The condition of the segment of the route is determined based on a combination of the two or more route parameters. At least one operational aspect of the vehicle system is controlled in response to the determined condition of the route.

In one aspect, controlling the at least one operational aspect of the vehicle system can include slowing, stopping or rerouting the vehicle system in response to the condition of the route segment being below a determined threshold prior to or during the vehicle system traversing the segment.

BRIEF DESCRIPTION OF THE DRAWINGS

The subject matter described herein may be understood from reading the following description of non-limiting embodiments, with reference to the attached drawings, wherein.

DETAILED DESCRIPTION

Figure 1:
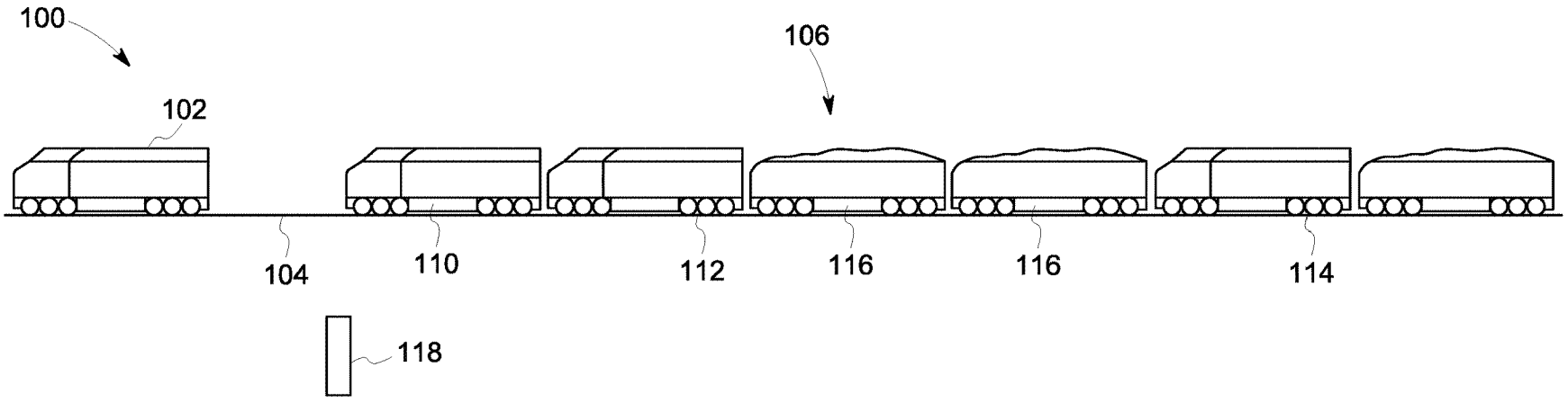
FIG. 1 is a schematic illustration of a vehicle system according to one example of the inventive subject matter.

One or more embodiments of the inventive subject matter described herein relate to a vehicle control system, and to associated methods of vehicle control. This "holistic inspection system" may obtain and use information from multiple sources to allow the vehicle control system to operate in a determined manner. While several examples of the inventive subject matter are described in terms of rail vehicles, not all embodiments of the inventive subject matter are limited to rail vehicles. At least some of the inventive subject matter may be used in connection with other vehicles, such as mining equipment, automobiles, marine vessels, airplanes, over the road trucks, or the like. And, where appropriate, the term track may be interchanged with path, road, route, or the like as may be indicated by language or context. Further, the term track (as well as path, road, route, etc.) may include specific segments of such, and further may include features that form a part of the track. For example, reference may be made to a bridge or other infrastructure that forms part of the route.

By having route detection (rail and track geometry) mounted on a powered vehicle, with sensors mounted on each car mechanically or logically coupled to the powered vehicle and communicating therewith, the powered vehicle may be "aware" of an operational change, deviation or failure on either or both of the track or the coupled car component, and a vehicle control system of the vehicle can responsively initiate a new operating mode in which the powered vehicle changes its speed, direction, or some other operating parameter. In addition, the track and vehicle system status detection may be more continuous, and less discrete or segmented (either by time or by space, or by both time and space). And, analysis of historical data may provide prognostic information relating to a particular vehicle operating at a particular track location.

As used herein, the term continuous means generally without significant interruption. The term discrete means confined to a location/geography or to a period of time. For example, discrete examination of a route may refer to a measurement or other examination of the route that occurs during a finite time period that is separated (in terms of time and/or location) from other discrete examinations by a significantly longer period of time than the finite time period. In contrast, continuous examination may refer to a measurement or other examination of the route that extends over a longer period of time (e.g., during an entire trip of a vehicle system from a starting location to a final destination location of the trip), that is frequently repeated, or the like. In one embodiment, discrete examinations of the route may be separated in time and/or location such that the condition of the route may significantly change between the discrete examinations. For example, a first discrete examination of the route may not identify any crack, pitting, or the like, of the route, but a subsequent, second discrete examination of the route may identify one or more cracks, pits, or the like, at the same location along the route. In contrast, a continuous examination of the route may be frequently repeated and/or non-stop such that the changing condition of the route is detected as the route condition is changing (e.g., the examination may witness the damage to the route).

In one embodiment, a system includes route examination equipment and a controller. The route examination equipment can obtain a route parameter indicative of a condition of a route over which a vehicle system travels. The controller receives the route parameter, and examines the route parameter to determine the condition of the route. The controller controls at least one operational aspect of the vehicle system in response to the determined condition of the route.

The route examination equipment can include one or both of a stationary wayside unit and a mobile route inspection unit. Suitable stationary wayside units may include one or more of a video (visible light) sensor unit, an infrared sensor unit, and an electrical current sensor. The electrical current sensor can determine if an electrical break or an electrical short has occurred in a monitored segment of the route.

If the vehicle system is one of a plurality of like vehicle systems, and the mobile route inspection unit includes an inspection system mounted on another, second vehicle system of the plurality of vehicle systems operating over the segment of the route prior to the first vehicle system then the system can use data for a route segment even if it was inspected by a different vehicle system's equipment. The system can, for example, organize the inspection results by chronology so as to present a trend over time and then can use that trend information predictively. Additionally or alternatively, the system can use a data set from a particular period, and then refer to a table (or the like) to determine what the expected degradation rate would be from the time of the data set until the time the vehicle is expected to travel over the corresponding segment.

Other suitable mobile route inspection units may include one or more of a drone or unmanned vehicle, an inspection system secured to the vehicle system as it travels over a segment of the route, or an inspection system mounted on an inspection vehicle having the primary purpose of inspecting the route. A primarily purposed inspection vehicle may include a Hi-Rail vehicle (with respect to rail usage) having gel-filled ultrasound wheels. A mounted inspection system may be secured to (again, with reference to rail usage) the locomotive and/or one or more of the rail cars. For on-road vehicles, the mounted inspection system can be secured to automobiles, tractor-trailers, busses, and the like.

Where the route parameters are collected by a drone, the drone can obtain images of the route using one or more of visible light video, infrared, Light Detection and Ranging (Lidar), ultrasound, and radar. Suitable drones can include an aerial drone or a surface vehicle. If the drone is a surface vehicle drone it may be autonomous or semi-autonomous as it travels over the segment of the route. Other suitable surface drones may be remotely piloted.

The stationary wayside unit may provide substantially continuous signals indicating the condition of the route, while the mobile route inspection unit may provide substantially periodic signals indicating the condition of the route. To be clear, the signal from the mobile unit may be continuous in its operation, but it may pass over a particular geography periodically. The controller can determine the condition of the route based at least in part on both the substantially continuous signals and on the substantially periodic signals. And, to do so, it may need to pull information from different data sets so that it can match data for a particular route segment. And, as mentioned, it may need to organize the data for a given segment based on the time stamp.

With regard to the at least one operational aspect of the vehicle system, in one embodiment the operational aspect is vehicle system speed. The controller can control the vehicle system speed over the route, and particularly the route segments, based on the determined condition relative to a determined threshold value for that condition. If the condition indicates the route is impassible (e.g., for a rockslide or a washout) the controlled vehicle system speed may be zero to stop the vehicle system prior to the vehicle system arriving at a segment of the route. Of note, the signal to stop would not be expected to be applied upon the mere identification of the route hazard. The vehicle system may still be many miles away from the segment in question. It may be slowed, it may be re-routed, or it may be slowed to a stop based on the stopping distance for a particular vehicle type. Additional messages, such as to initiate a fix of the route damage (e.g., repair a broken rail, fill a pot hole, etc.) may be generated and sent to the appropriate agency to remedy the situation. As noted, in one embodiment, the at least one operational aspect of the vehicle system is the route, and the controller can control the vehicle system to change at least a portion of the route from a first route portion to a second route portion, if the first route portion has a segment that has the determined condition below a determined threshold value and if the second route portion does not include the segment with the determined condition. In another embodiment, the operational aspect may be to urge the vehicle relatively left, right, up or down compared to an otherwise unaltered path.

Expanding on the determined condition, suitable conditions that may require the controller to respond may include one or more of a broken rail if the vehicle system is a locomotive, a rockslide or mudslide over the route, a washout of the route, a snow drift over the route, pitting, potholes downed power lines, obstacles in an upcoming crossing, loose ties, missing ballast, sinkholes, fissures, heavy fog, ice, and the like.

Where the route examination equipment is a drone, and the drone can switch operating modes, the switch is to shift from a first operating mode of identifying the segment of the route having a determined condition to a second operating mode where the drone can signal a location of the segment, signal a type of determined condition, signal a location of the route examination equipment, signal information about the segment of the route, perform additional sensing tests or procedures that are different from those used in the identifying of the segment, and control the route examination equipment movement. Controlling the route examination equipment movement may include one or more of the drone hovering for a determined period proximate to the segment, landing proximate to the segment, parking the route proximate to the segment, changing positions to obtain additional perspectives of the segment, and obtaining higher definition or closer images of the segment.

During operation, the system can obtain one or more route parameters indicative of a condition of a segment of a route over which a vehicle system travels; determine the condition of the segment of the route based on the one or more route parameters; and control at least one operational aspect of the vehicle system in response to the determined condition of the route. Controlling at least one operational aspect of the vehicle system may include, for example, slowing, stopping or rerouting the vehicle system in response to the condition of the route segment being below a determined threshold prior to or during the vehicle system traversing the segment. In one embodiment, two or more route parameters may be used. And, in one embodiment, vehicle operating parameters indicating a condition of the vehicle systems may be combined with the condition of the route to further allow the controller to control the operation of the vehicle system.

Additionally or alternatively, in one embodiment, the system can obtain a status of the vehicle system, and can control the operational aspect of the vehicle system in response to both the determined condition of the route and to the status of the vehicle system. For example, a vehicle with new tires may not be instructed to slow but a vehicle with worn tires may be instructed to slow when approaching a stretch of road that has an indication of a certain amount of snow or ice relative to a threshold level of snow or ice (using an on-road example). Or, a passenger car might be instructed differently than a tractor-trailer rig under a heavy load. Additional stopping distance or time might be needed, different speed limits might be in play, and so on.

With reference to FIG. 1, a schematic illustration of an embodiment of an examination system 100 is shown. The system includes a test vehicle 102 disposed on a segment of route 104 leading a vehicle system 106. The route can be a track, road, or the like. The test vehicle can represent a rail test vehicle and the vehicle system can represent a train. Optionally, the vehicle may be another type of vehicle, the track can be another type of route, and the train can represent a vehicle system formed from two or more vehicles traveling together along the route. The vehicle system includes a lead vehicle 110 and a trail vehicle 112 in consist, and a remote vehicle 114 operating under a distributed power system, such as LOCOTROL Distributed Power available from GE Transportation. Between the trail vehicle and the remote vehicle are a plurality of cars 116. The vehicles and cars can represent locomotives and rail cars, but optionally can represent other types of vehicles. The vehicles 112, 114 may be referred to as propulsion-generating vehicles and the cars 116 may be referred to as non-propulsion-generating vehicles. A wayside unit 118 is disposed proximate to the route. The wayside unit is one of a plurality of such units (not shown) that are dispersed periodically along the route. A drone that can travel down the route is not shown.

At least the lead vehicle has communication equipment that allows for data transmission with one or more other equipment sets off-board that vehicle. Suitable off-board equipment may include, as examples, cellular towers, Wi-Fi, wide area network (WAN) and Bluetooth enabled devices, communication satellites (e.g., low Earth orbiting or "LEO" satellites), other vehicles, and the like. These communication devices may then relay information to other vehicles or to a back office location. The information that is communicated may be in real time, near real time, or periodic. Periodic communications may take the form of "when available" uploads, for data storage devices that upload to a data repository when a communication pathway is opened to them. Also included are manual uploads, and the like, where the upload is accomplished by downloading the information to a USB drive or a computing device (smart phone, laptop, tablet and the like), and from that device communicating the information to the repository.

With regard to the test vehicle, the test vehicle may be run over the route at a certain frequency or in response to certain trigger conditions. Route examination equipment 314 (shown in FIG. 3) onboard the test vehicle includes sensors that measure one or more parameters. The parameters can include route parameters, structure parameters, and/or environmental parameters. The route parameters may include level, grade, condition, spalling, gauge spread, and other forms of damage to the route. Structure parameters may further include information about the route bed and ballast, joints, the health of ties or sleepers, fasteners, switches, crossings, and the sub-grade. Environmental parameters may include information relating to proximate surroundings (such as brush or trees), or other such conditions on or near the route, grease or oil, leaves, snow and ice, water (particularly standing or flowing water on the tracks), sand or dirt build up, and the like.

The test vehicle may be land based on rails (as in the illustrated embodiment), but may be a hi-rail vehicle, may travel alongside the route (that is, wheeled), or may be airborne in the form of a drone, for example. The test vehicle may be a self-propelled vehicle, or the test vehicle may be manually run along the route such as, for example, the Sperry B-Scan Single Rail Walking Stick (available from Sperry Rail Service, a Rockwood Company) or pulled by a powered vehicle. The route examination equipment 314 onboard the test vehicle may use video, laser, x-ray, electric induction, and/or ultrasonics to test the route or a catenary line for faults, defects, wear, damage, or other conditions. For ease of discussion, all references to route will include a reference to catenary lines as appropriate. The test vehicle may include a location device (such as a global positioning system receiver) so that the segment of the route being tested at a discrete point in time and location can result in a route profile.

The locomotive may include a location device and sensors that detect operational information from the locomotive. In such a way, for example, an impact sensor on the locomotive may record an impact event at a known time and location. This may indicate, among other things, a fault, defect, wear or damage (or another condition) of the track. Alternatively, the detected event may be associated with, for example, a wheel and not the track. A wheel with a flat spot, or that is out of alignment, or that has some other defect associated with it may be identified by sensors on board the locomotive. The locomotive may include the communication device that allows such information to be communicated to a back office, and may include a controller that may analyze the information and may suggest to the locomotive operator or may directly control the operation of the locomotive in response to an analysis of the information.

The rail car may include sensors that, like the locomotive, detect events associated with the track, a catenary line, the rail car, or both. Further, communication devices may be mounted on or near the rail car sensors. In one embodiment, these communication devices may be powerful enough to communicate over a distance and directly port sensor data to an off-board receiver. In another embodiment, the rail car communication devices are able to feed data to one or more locomotives. The communication feed through may be wired (for example, the Ethernet over multiple unit (eMU) product from GE Transportation) or wireless. The locomotive may then store and/or transmit the data as desired.

The wayside detectors may include sensors that measure impact force, weight, weight distribution and the like for the passing train. Further, other sensors (e.g., infrared sensors) may track the bearings health and/or brake health, and the health and status of like propulsion components. In one example, a locked axle for an AC combo may heat up and the heat may be detected by a wayside monitor.

Figure 2:
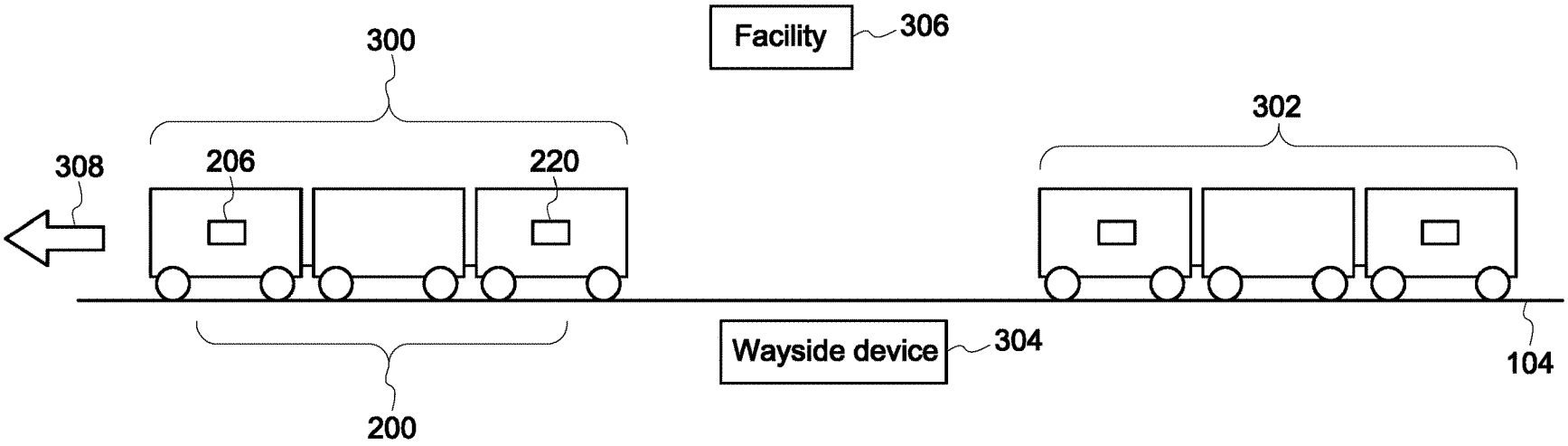
FIG. 2 is a schematic illustration of a vehicle system according to one example of the inventive subject matter.

With reference to FIG. 2, a segment of track 200 is occupied by a first train set 300 that includes a lead vehicle having an inductance based broken rail detection system 206 and a trail vehicle that has an impact sensor 220 that can sense the health of the rail tracks over which it runs. A second train set 302 is traveling on a different portion of the same track as the segment with the first train set. A wayside device 304 is disposed proximate to the track. A back office facility 306 is remote from the first train set, the second train set and the wayside device.

During operation, the broken rail detection system and the impact sensor can sense discontinuities in the track and/or in the wheels. That information is supplied to the locomotive powering the first train set (not shown), and is reported to the facility. The information from the wayside notes the health of the wheels and combos of the first train set as it passes the wayside device. The wayside device reports that information to the facility. There may be a period of time and/or distance prior to which the health of the wheels and combos of the first train set are not monitored by a wayside device. This may be due to the spacing of the wayside devices relative to each other along the route. Of note, just as the wayside devices may provide health information at discrete distances, if the route is checked by rail test vehicles periodically such health information is provided at discrete times. Further, the accuracy and reliability of the periodic rail test vehicle will diminish and degrade over time.

The locomotive, or powered vehicle, may be informed of the information from on-board sensors, as well as the historic data about the upcoming track from a rail test vehicle from one or more previous surveys of the track segment, and further with information from the wayside device or devices about the track segment and/or the wheel and/or combo health of the rail cars coupled to the locomotive. With this information, a controller in the locomotive may alter the operation of the locomotive in response to encountering a section of track in which there is a concern about the health or quality of the track, or in response to the health of a wheel or combo on a rail car in the train powered by the locomotive.

In one embodiment, the train may be traveling along the route according to a trip plan that designates operational settings of the train as a function of one or more of distance along the route or time. For example, the trip plan may dictate different speeds, throttle positions, brake settings, etc., for the train at different locations along the route. A locomotive pulling the first train set illustrated in FIG. 2 communicates with the facility and downloads data (learns) to the effect (for example) that the three previous rail test cars passing through a curve in an upcoming rail section detected that there were signs of the beginnings of cracks in the rails. The rails were still "in spec" when tested, but just barely, and further, there had been heavy traffic over that segment in the previous days since the last test. Further, the last wayside device noted rather severe flat spots on a damaged rail car towards the end of the mile-long first train set. The locomotive controller may then alter the trip plan in response to the information received from the various information sources. For example, the locomotive may slow down the entire first train set to navigate the curve in the track segment, and when the damaged rail car is set to enter the curve the locomotive may slow the first train set down to an even slower speed. The impact from the flat wheel spots at the slower speed may have a correspondingly lower chance of damaging the track at the curve, or of breaking either the track or the wheel set. After the first train set has cleared the curve and the track health is improved relative to the curve the locomotive may accelerate back to normal speed or to a third speed that is determined to be an efficient speed based on the health of the damaged rail car's wheel and the health of the track.

Using a different example, the combination of discrete information sources (geographically discrete and temporally discrete) with continuous monitoring by an on-board rail health monitor and/or broken rail detector allows for the controller in the locomotive to provide real time control over the speed and operation of the train. In one embodiment, information from a wayside detector can inform a locomotive that there is a problem or potential problem with a wheel and/or combo. The locomotive may then switch operating modes based on that information. One potential operating mode involves slowing or stopping the train. Another potential operating mode involves monitoring the train set for indications that the wheel and/or combo are exhibiting the problem. For example, if a wayside detector indicates that there is a hot axle, the locomotive can monitor the train for increased drag. If an axle seizes up, the increased resistance (or increased coupler force if there is a coupler sensor) can be detected as increased drag and an on-board the rail car sensor can alert the locomotive controller. The controller can then implement a determined action in response to detecting the increased drag.

Suitable other operating modes may include the use or prevention of the use of adhesion modifiers. Adhesion modifiers may be materials applied to a section of the track, such as lubricants or traction enhancers. Naturally, the lubricants may reduce friction and grip, while the traction enhancers increase it. Suitable traction enhancers may include blasted air (under defined conditions) as well as sanding and other traction enhancing techniques. Yet another operating mode may include engaging or disabling a dynamic weight management (DWM) system. The DWM system may lift or drop one or more axles to affect the weight distribution of a vehicle or vehicle system. And, another operating mode may reduce or increase wheel torque, may engage or prevent one or the other of dynamic braking or air braking, or may control the rate at which a vehicle may change its rate of acceleration or deceleration (for locomotives, that may be the rate at which notch levels may be changed).

In one embodiment, the combination of information from the plurality of discrete sources and the continuous source(s) is used to reduce or prevent derailment due to a broken wheel. In one embodiment, the combination of information from the plurality of discrete sources and the continuous source(s) is used to prevent derailment due to a locked axle. In one embodiment, the combination of information from the plurality of discrete sources and the continuous source(s) is used to prevent derailment due to a broken rail. In various embodiments, other sources of information may provide additional information. For example, weather services may provide data about the current, previous, or upcoming weather events.

In other contemplated embodiments, logically coupled or remote controlled vehicles may be used rather than locomotives. Logically coupled groups of vehicles include those that are not mechanically coupled (as are locomotives, multi-unit over-the-road trucks, and the like) but rather have a control system that operates the vehicle (speed, direction, and the like) relative to another vehicle that is nearby or relative to a stationary object. In that manner, a lead vehicle may have a human operator with a trail vehicle that is otherwise driverless and is controlled by the lead vehicle so that it, for example, follows behind and mirrors the movement and speed of the lead vehicle.

Figure 3:
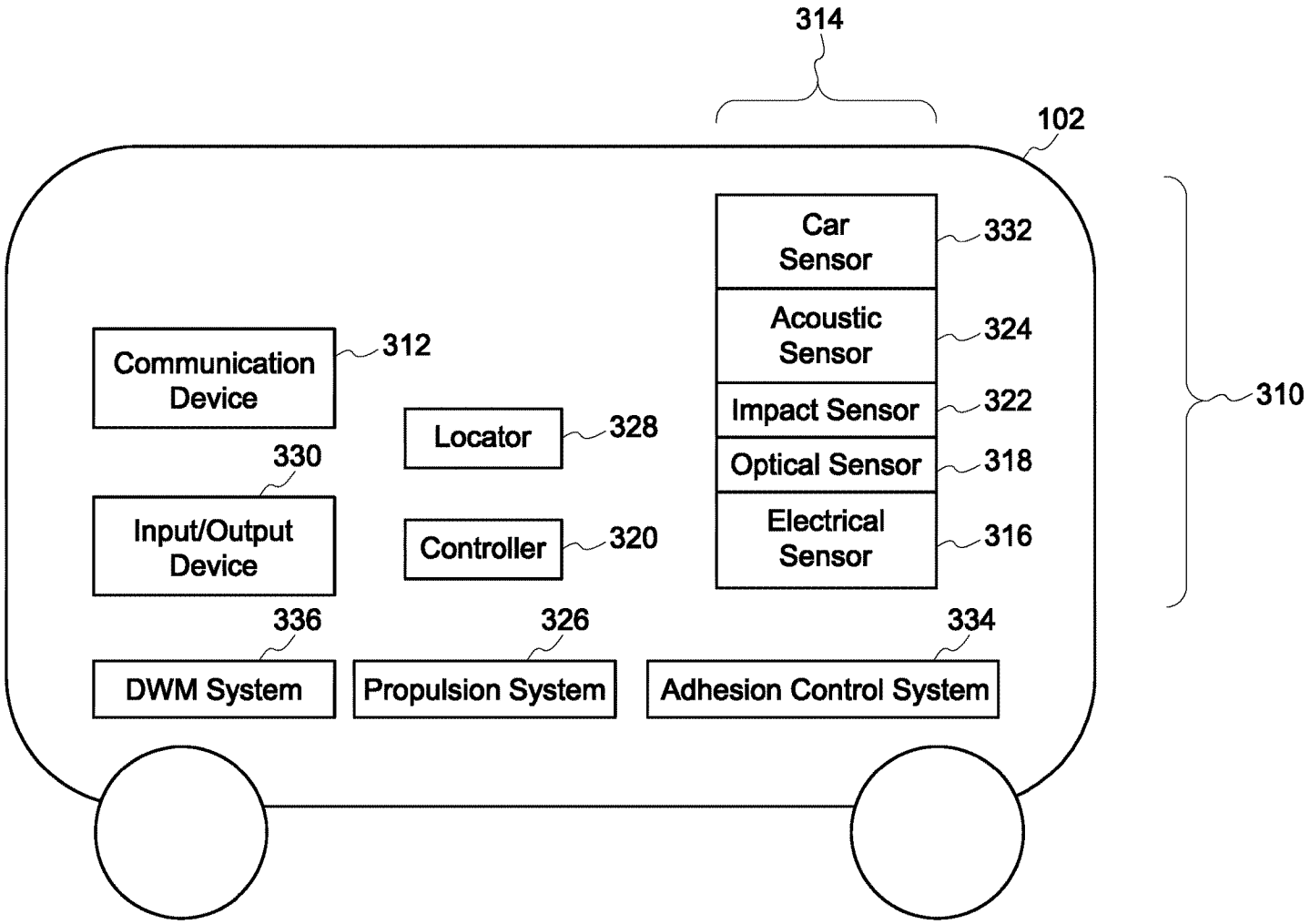
FIG. 3 includes a schematic illustration of an examination system according to one embodiment.

FIG. 3 includes a schematic illustration of vehicle examination equipment 310 of the examination system 100 according to one embodiment. The vehicle examination equipment 310 is shown as being disposed onboard the test vehicle, but optionally may be disposed onboard another vehicle and/or may be distributed among two or more vehicles in the vehicle system 106 shown in FIG. 1. The vehicle examination equipment 310 includes communication equipment 312 ("Communication Device" in FIG. 3) that allows for data transmission with one or more other equipment sets off-board that vehicle. The communication equipment 312 can represent transceiving circuitry, such as modems, radios, antennas, or the like, for communicating data signals with off-board locations, such as other vehicles in the same vehicle system, other vehicle systems, or other off-board locations. The communication equipment can communicate the data signals to report the parameters of the route as measured by the examination system. The communication equipment can communicate the data signals in real time, near real time, or periodically.

The route examination equipment 314 can include one or more electrical sensors 316 that measure one or more electrical characteristics of the route and/or catenary as parameters of the route and/or catenary. The electrical sensor may be referred to as a broken rail monitor because the electrical sensor generates data representative of whether the rail of a route is broken. The electrical sensors 316 can include conductive and/or magnetic bodies such as plates, coils, brushes, or the like, that inject an electrical signal into the route (or a portion thereof) and that measure one or more electrical characteristics of the route in response thereto, such as voltages or currents conducted through the route, impedances or resistances of the route, etc. Optionally, the electrical sensors 316 can include conductive and/or magnetic bodies that generate a magnetic field across, though, or around at least part of the route and that sense one or more electrical characteristics of the route in response thereto, such as induced voltages, induced currents, or the like, conducted in the route.

In one aspect, the electrical sensor 316 and/or a controller 320 of the examination system 100 can determine structure parameters and/or environmental parameters of the route based on the electrical characteristics that are measured. For example, depending on the voltage, current, resistance, impedance, or the like, that is measured, the route bed and/or ballast beneath the route may be determined to have water, ice, or other conductive materials (with the voltage or current increasing and the resistance or impedance decreasing due to the presence of water or ice and the voltage or current decreasing and the resistance or impedance increasing due to the absence of water or ice) and/or damage to joints, ties, sleepers, fasteners, switches, and crossings can be identified (with the voltage or current increasing and the resistance or impedance decreasing for less damage and the voltage or current decreasing and the resistance or impedance increasing due to the increasing damage).

The route examination equipment 314 can include one or more optical sensors 318 that optically detect one or more characteristics of the route and/or catenary as parameters of the route and/or catenary. The optical sensor may be referred to as a broken rail monitor because the optical sensor generates data representative of whether the rail of a route is broken. The optical sensor 318 can include one or more cameras that obtain images or videos of the route, LIDAR (light generating devices such as lasers and light sensitive sensors such as photodetectors) that measure reflections of light off various portions of the route, thermographic cameras that obtain images or videos representative of thermal energy emanating from the route or catenary, etc. Optionally, the optical sensor 318 can include one or more x-ray emitters and/or detectors that generate radiation toward the route and/or the areas around the route and detect reflections of the radiation off of the route and/or other areas. These reflections can be representative of the route and/or damage to the route.

The optical sensor 318 can represent hardware circuitry that includes and/or is connected with one or more processors (e.g., microprocessors, field programmable gate arrays, integrated circuits, or other electronic logic-based devices) that examine the data measured by the optical sensor 318 to generate parameters of the route. For example, the optical sensor 318 can examine the images, videos, reflections of light, etc., to determine parameters such as geometries of the route (e.g., curvature of one or more rails, upward or downward bends in one or more rails, grade of the route, etc.), damage to the route (e.g., cracks, pits, breaks, holes, etc. in the route), a type of the route (e.g., a track, a road, etc.), or other information about the route. Alternatively, the optical sensor 318 may obtain the images, videos, reflections, etc., and report this data to the controller 320, which examines the data to determine the parameters of the route. In one aspect, the optical sensor and/or the controller can determine route parameters, structure parameters, and/or environmental parameters of the route using the optical data that is obtained by the optical sensor.

The vehicle examination equipment 310 can include one or more impact sensors 322 that detect impacts of the vehicle during movement along the route. The impact sensor may be referred to as a broken rail monitor because the impact sensor generates data representative of whether the rail of a route is broken. Optionally, the impact sensor may be referred to as an asset health monitor because the impact sensor generates data representative of the condition of the vehicle or vehicle system. The impact sensor 322 can represent an accelerometer that generates data representative of accelerations of the vehicle, such as those accelerations that can occur when one or more wheels of the vehicle travel over a damaged portion of the route, wheels travel over a gap between neighboring sections of the route, a wheel of the vehicle has a flat spot, a wheel is not aligned with the route (e.g., with a rail of the route), or a wheel has some other defect associated with it, etc. The impact sensor 322 can represent hardware circuitry that includes and/or is connected with one or more processors (e.g., microprocessors, field programmable gate arrays, integrated circuits, or other electronic logic-based devices) that examine the accelerations measured by the impact sensor 322 to generate parameters of the route. For example, the impact sensor 322 can examine the accelerations to determine whether the vehicle traveled over a gap in the route, such as may occur when the route is broken into two or more neighboring sections. Alternatively, the impact sensor 322 may measure the accelerations and report the accelerations to the controller 320, which examines the accelerations to determine the parameters of the route.

The route examination equipment 314 can include one or more acoustic sensors 324 that detect sounds generated during movement of the vehicle along the route. The acoustic sensor may be referred to as a broken rail monitor because the acoustic sensor generates data representative of whether the rail of a route is broken. In one embodiment, the acoustic sensor includes one or more ultrasound or ultrasonic transducers that emit ultrasound waves or other acoustic waves toward the route and detect echoes or other reflections of the waves off the route and/or locations near the route (e.g., the surface beneath the route, objects or debris on top of the route, etc.). The detected echoes or reflections represent acoustic data of the route, which may be used to determine parameters of the route. Optionally, the acoustic sensor can represent an acoustic pick up device, such as a microphone, that generates data representative of sounds generated by the vehicle traveling over the route. Sounds may be generated when one or more wheels of the vehicle travel over a damaged portion of the route, a gap between neighboring sections of the route, etc. The acoustic sensor can represent hardware circuitry that includes and/or is connected with one or more processors (e.g., microprocessors, field programmable gate arrays, integrated circuits, or other electronic logic-based devices) that examine the sounds detected by the acoustic sensor to generate parameters of the route. For example, the acoustic sensor can examine the sounds to determine whether the vehicle traveled over a gap in the route, such as may occur when the route is broken into two or more neighboring sections. Alternatively, the acoustic sensor may detect the sounds and report the sounds to the controller, which examines the sounds to determine the parameters of the route.

The acoustic sensor and/or controller can determine route parameters, structure parameters, and/or environmental parameters from the sounds that are detected. For example, the echoes that are detected by the acoustic sensor may be examined to identify cracks, pits, or other damage to the route. These echoes may represent areas inside the route that are damaged, which may not be visible from outside of the route. Optionally, designated sounds and/or sounds having one or more designated frequencies may indicate damage to the route that indicates changes in the level, grade, condition, grade, or the like of the route, changes in the route bed or ballast, damage to joints, damage to ties or sleepers, damage to fasteners, damage to or improperly functioning switches, improperly functioning crossings, changes to the sub-grade, the presence of brush or trees near the route (e.g., when the vehicle contacts the brush or trees), travel of wheels over segments of the route having grease or oil disposed on the route, the presence of leaves of the route, the presence of snow, ice, or water on the route, sand or dirt build up on the route, and the like.

The vehicle examination equipment 310 can include one or more car sensors 332 that detect characteristics of the test vehicle or another vehicle in the same vehicle system. The car sensor may be referred to as an asset health monitor because the car sensor generates data representative of the health of the vehicle or vehicle system. The car sensor 332 can include one or more speed sensors (e.g., tachometers), accelerometers, thermal sensors (e.g., infrared sensors that detect heat given off of bearings, axles, wheels, or the like), or other sensors that detect characteristics of the vehicle. The car sensor and/or controller can determine car parameters of the test vehicle and/or another vehicle in the vehicle consist. For example, the speeds that are detected by the car sensor may be rotational speeds of one or more wheels of the vehicle, and can be used to measure wheel creep or other characteristics representative of adhesion between the wheels and the route. The car sensor can measure accelerations of the vehicle to determine impacts of the vehicle on the route and/or with another vehicle in order to determine how much force is imparted on the vehicle and/or route. The car sensor can measure temperatures of bearings, axles, wheels, or the like, in order to determine if the bearings, axles, wheels, or the like, are overheating (and possibly indicative of a stuck axle or wheel).

While the test vehicle is illustrated as including wheels for land-based travel, as described above, the test vehicle optionally may travel on land using other components, may fly alongside or above the route (e.g., as an aerial vehicle), or the like. The test vehicle may include a propulsion system 326 that performs work to propel the test vehicle. The propulsion system can represent one or more engines, alternators, generators, batteries, capacitors, motors, or the like, that generate and/or receive energy (e.g., electric current) in order to power vehicle and propel the vehicle along the route. Alternatively, the test vehicle may not include the propulsion system. For example, the test vehicle may be pulled and/or pushed along the route by one or more other vehicles having propulsion systems, or may be manually pulled and/or pushed along the route.

While the preceding description focuses on the sensors onboard the test vehicle examining the route, optionally, one or more of the sensors may examine a catenary from which the test vehicle or the vehicle system that includes the test vehicle obtains electric current (e.g., for powering the vehicle system). For example, the electrical sensor may sense the current supplied from the catenary in order to identify surges or drops in the current (which may be indicative of damage to the catenary or equipment onboard the vehicle that receives current from the catenary). As another example, the optical sensor may obtain images of the catenary, videos of the catenary, or x-ray reflections off of the catenary in order to identify damage to the catenary.

The test vehicle includes a location device 328 ("Locator" in FIG. 3) that determines locations of the test vehicle or the vehicle system along the route at one or more times. The location device optionally may be disposed onboard another vehicle of the vehicle system that includes the test vehicle. The location device can include a global positioning system receiver, a wireless antenna, a reader that communicates with roadside transponders, or the like. Based on signals received from one or more off-board sources (e.g., satellites, cellular signals from cellular towers, wireless signals from transponders, etc.), the location device can determine the location of the location device (and, consequently, the test vehicle or vehicle system). Optionally, the location device can represent hardware circuitry that includes and/or is connected with one or more processors (e.g., microprocessors, field programmable gate arrays, integrated circuits, or other electronic logic-based devices) and/or a speed sensor (e.g., a tachometer). The location device can determine the location of the test vehicle or vehicle system by integrating speeds measured by the speed sensor over time from a previously known or determined location in order to determine a current location of the test vehicle and/or vehicle system.

The controller of the test vehicle represents hardware circuitry that includes and/or is connected with one or more processors (e.g., microprocessors, field programmable gate arrays, integrated circuits, or other electronic logic-based devices) that may examine the data measured by the route examination equipment 314 to determine parameters of the route (e.g., route parameters, environmental parameters, structure parameters, etc.). Optionally, the examination system 100 may determine one or more of these parameters. The controller may communicate with an input/output device 330 and/or the propulsion system to control movement of the test vehicle and/or vehicle system (that includes the test vehicle) based on the parameters that are determined. For example, the controller may automatically change operation of the propulsion system to stop or slow movement of the vehicle system responsive to determining that a parameter indicates damage to the route, damage to the vehicle (e.g., damage to a wheel), debris on the route, or other unsafe operating conditions. Alternatively, the input/output device can represent one or more displays, touchscreens, speakers, or the like, that the controller can cause to present instructions or warnings to an operator of the vehicle system. The controller may cause the instructions or warnings to be displayed to cause the operator to change operation of the vehicle or vehicle system in response to determining that one or more of the parameters indicates an unsafe operating condition. The input/output device optionally can represent one or more input devices, such as levers, buttons, touchscreens, keyboards, steering wheels, or the like, for receiving input into the controller from an operator of the vehicle system.

In one embodiment, responsive to determining that a parameter indicates damage or deteriorating conditions of the route, the controller may communicate a warning signal to an off-board location, such as the facility 306 shown in FIG. 2. This warning signal may report the parameter that is indicative of the route damage or deteriorating condition, and the location at which the damage or deteriorating condition is identified. The deteriorating condition may include debris on the route, shifted or decreased ballast material beneath the route, overgrown vegetation on the route, damage to the route, a change in geometry of the route (e.g., one or more rails have become bent or otherwise changed such that the shape of one segment of the route is different from a remainder of the route), etc. The warning signal may be communicated automatically responsive to determining the parameter, and may cause the off-board location to automatically schedule additional inspection, maintenance, or repair of the corresponding portion of the route. In one embodiment, communication of the warning signal may cause the off-board location to change the schedules of one or more other vehicle systems. For example, the off-board location may change the schedule of other vehicle systems to cause the vehicle systems to travel more slowly or to avoid the location with which the parameter is associated. Optionally, the warning signal may be broadcast or transmitted by the communication device to one or more other vehicles to warn the vehicles, without being first communicated to the off-board location.

In one example of operation of the test vehicle, the vehicle can operate as a self-aware vehicle that continuously monitors itself and/or the route during movement of the vehicle or vehicle system along the route. Some known rail safety systems and methods consist of visual inspections of a track (e.g., hi-rail systems) and cars (e.g., such as visual inspections that occur in rail yards) combined with periodic inspections of the track and inspection of the cars by stationary wayside units. One significant drawback with these known systems and methods is that the inspections of the route and vehicles are discrete in time and space. With respect to time, the track and/or cars may only be inspected periodically, such as every three weeks, every six months, and the like. Between these discrete times, the track and/or cars are not inspected. With respect to location, the cars may be inspected as the cars move past stationary wayside units disposed at fixed locations and/or portions of the track that are near stationary wayside units may be inspected by the units, but between these locations of the wayside units, the track and/or cars are not inspected.

The examination system 100 described herein can operate using the test vehicle as a hub (e.g., a computer center) that is equipped with broken route inspection equipment (e.g., the route examination equipment 314) for detecting damage or deteriorating conditions of the route during movement of the test vehicle. The parameters of the route that are generated by the examination system 100 can be used to identify damaged sections of the route or sections of the route that require repair or maintenance. Optionally, the controller of the test vehicle can examine both the parameters provided by the examination system 100 and historical parameters of the route. The historical parameters of the route can include the parameters determined from data measured by the examination system 100 onboard the test vehicle and/or one or more other test vehicles during a previous time or trip. For example, the historical parameters may represent the condition or damage of the route as previously measured by the same or a different examination system. The historical parameters may be communicated from an off-board location, such as the facility 306 shown in FIG. 2, and based on the data measured by and provided from the examination systems onboard the same and/or different vehicles.

The examination system 100 onboard a test vehicle can use a combination of the currently determined parameters (e.g., the parameters determined by the examination system onboard the test vehicle during movement of the test vehicle) and previously determined parameters (e.g., the parameters determined by the examination system onboard the same test vehicle or another test vehicle during a previous traversal over the same route or section of the route and/or parameters previously determined by one or more wayside units) to control operation of the vehicle system. As one example, if previously determined parameters indicate that damage to a segment of the route is increasing (e.g., a size of a crack in the rail is increasing), but is not yet sufficiently severe to cause the vehicle system to avoid the segment of the route, to warn other vehicle systems of the damage, or to request inspection, repair, and/or maintenance of the route, then the controller may activate one or more of the route examination equipment 314 (e.g., where not all of the examination equipment is constantly activated) for continuous monitoring of the parameters of the route during movement over the same segment of the route.

The vehicle examination equipment 310 onboard a test vehicle can use a combination of the currently determined parameters of the vehicle and previously determined parameters of the vehicle to control operation of the vehicle system. As one example, if a warm or hot bearing is detected by a wayside unit on a particular car in a vehicle system, then the examination system 100 can direct the car sensor 332 onboard that car to measure the temperature of the bearing more frequently and/or at a finer resolution in order to ensure that the bearing temperature does not increase exponentially between wayside units.

The vehicle system that includes the test vehicle optionally may include an adhesion control system 334. Although the adhesion control system is shown in FIG. 3 as being onboard the test vehicle, optionally, the adhesion control system may be disposed onboard another vehicle of the same vehicle system. The adhesion control system represents one or more components that apply one or more adhesion-modifying substances to the route in order to change adhesion between the vehicle system (or a portion thereof) and the route. The adhesion control system can include one or more sprayers or other application devices that apply the adhesion-modifying substances and/or one or more tanks that hold the adhesion-modifying substances. The adhesion-modifying substances can include air, lubricants, sand, or the like. The controller may direct the adhesion control system as to when to apply the adhesion-modifying substances, which adhesion-modifying substances to apply, and how much of the adhesion-modifying substances are to be applied.

Based on the parameters of the route and/or vehicle that are determined by the examination system 100, the operating mode of the controller may change to use or prevent the use of adhesion-modifying substances. If the parameters indicate that wheels of the vehicle system are slipping relative to the route, then the controller may prevent the adhesion control system from applying substances that reduce adhesion of the wheels to the route or may direct the adhesion control system to apply one or more substances that increase adhesion. If the parameters indicate that debris or other substances are on the route, then the controller may direct the adhesion control system to apply one or more substances that remove the debris (e.g., by directing air across the route).

The vehicle system that includes the test vehicle optionally may include the DWM system 336. Although the DWM system is shown in FIG. 3 as being onboard the test vehicle, optionally, the DWM system may be disposed onboard another vehicle of the same vehicle system. The DWM system includes one or more motors, gears, and the like, that are interconnected with axles of the vehicle on which the DWM system is disposed and may lift or drop one or more axles (relative to the route). The raising or lowering of axles can change the weight distribution of the vehicle or vehicle system on the route. Based on the parameters of the route and/or vehicle that are determined by the examination system 100, the operating mode of the controller may change to raise or lower one or more axles of the vehicle system. If the parameters indicate that significant impact forces are being caused by wheels of the vehicle system, then the controller may direct the DWM system to raise those axles relative to the route or to lower multiple axles toward the route (and thereby reduce the force imparted by any single axle).

The controller may examine the parameters determined from the discrete sources (e.g., the manual and/or wayside unit inspection of the vehicle and/or route) to determine when to begin monitoring parameters of the vehicle and/or route using one or more continuous sources. For example, responsive to determining that a parameter of the vehicle or route (as determined from a wayside unit) indicates potential damage or deteriorating health (e.g., a damaged or bent rail, a hot bearing, etc.), the controller may direct the vehicle and route examination equipment 310, 314 to begin continually monitoring parameters of the vehicle and/or route. The continuous monitoring may be for purposes of confirming the potential damage, identifying deteriorating health (changes in damage over time), quantifying or characterizing a nature or aspect of the damage, determining information relevant to vehicle control based on detected damage, etc. With respect to the route, this can involve the controller directing the route examination equipment 314 to continually measure data and determine parameters of the route during travel over a segment of the route associated with a parameter determined by a discrete source that indicates damage or a deteriorating condition of the route. The controller may stop the continual examination of the route and/or vehicle responsive to exiting a segment of the route identified by a discrete source as being problematic, responsive to receiving one or more additional parameters from a discrete source indicating that another segment of the route is not problematic, or once the parameter of the vehicle is identified as no longer indicating a problem with the vehicle. The discrete sources of route parameters and/or vehicle parameters can include the wayside units, results of a manual inspection, or the like. In one embodiment, a weather service may provide data about the current, previous, or upcoming weather events as a discrete source of route parameters.

In one embodiment, the controller may use a combination of parameters from one or more discrete sources and one or more continuous sources to identify a broken wheel, locked axle, broken rail, or the like. For example, the parameters of the vehicle obtained from one or more wayside units may indicate that a wheel has a relatively small crack, flat spot, or other minor damage. The parameters may not be significant enough to cause the vehicle system to stop moving along the route. The controller may receive these parameters and then begin continually monitoring the wheel using one or more sensors of the vehicle examination equipment 310. The continually monitored parameter or parameters of the wheel may identify a decreasing trend in the health of the wheel. For example, the parameter that is continually monitored by the vehicle examination equipment 310 may demonstrate that the crack is growing in size, that the flat spot is growing in size, or that other damage to the wheel is getting worse with respect to time. The controller can examine the changes in the continually monitored parameter(s) of the wheel with respect to time and, responsive to the changes exceeding one or more limits or approaching one or more limits, the controller can slow down or stop movement of the vehicle system before the wheel breaks, automatically request a change in the schedule of the vehicle system to obtain inspection and/or repair of the wheel, automatically request maintenance or repair of the wheel, etc. This can result in the wheel being continually monitored in response to the discrete source of information (e.g., the wayside unit) determining that the wheel may have a problem that otherwise would not prevent the vehicle system from proceeding. Due to the continual monitoring of the wheel, derailment of the vehicle system may be avoided prior to a subsequent discrete examination of the wheel.

In another example, the parameters of the vehicle obtained from one or more wayside units may indicate that an axle may be at least partially stuck (e.g., the parameters may indicate elevated temperatures of bearings and/or a wheel connected with the axle). The controller may receive these parameters and then begin continually monitoring the axle using one or more sensors of the vehicle examination equipment 310. The continually monitored parameter or parameters of the axle may indicate an increasing temperature of the bearings. The controller can examine the changes in the continually monitored parameter(s) of the axle with respect to time and, responsive to the increasing temperatures exceeding one or more limits or approaching one or more limits, the controller can slow down or stop movement of the vehicle system before the axle locks up, automatically request a change in the schedule of the vehicle system to obtain inspection and/or repair of the axle, automatically request maintenance or repair of the axle, etc. This can result in the axle being continually monitored in response to the discrete source of information (e.g., the wayside unit) determining that the axle may have a problem that otherwise would not prevent the vehicle system from proceeding. Due to the continual monitoring of the axle, derailment of the vehicle system may be avoided prior to a subsequent discrete examination of the axle.

In another example, the parameters of the route obtained from one or more wayside units may indicate that a segment of the route is damaged (e.g., the parameters may indicate cracks in the route). The controller may receive these parameters prior to travel over the route segment and begin continually monitoring the route using one or more sensors of the route examination equipment 314. The continually monitored parameter or parameters of the route may indicate increasing damage to the route. The controller can examine the changes in the continually monitored parameter(s) of the route and, responsive to the increasing damage exceeding one or more limits or approaching one or more limits, the controller can slow down or stop movement of the vehicle system before the route is impossible to be traveled upon (e.g., a rail breaks), automatically request a change in the schedule of the vehicle system to avoid traveling over the route segment, automatically request maintenance or repair of the route segment, etc. This can result in the route being continually monitored in response to the discrete source of information (e.g., the wayside unit) determining that the route is at least partially damaged (but still able to be traveled upon). Due to the continual monitoring of the route, derailment of the vehicle system may be avoided prior to a subsequent discrete examination of the route.

Figure 4:
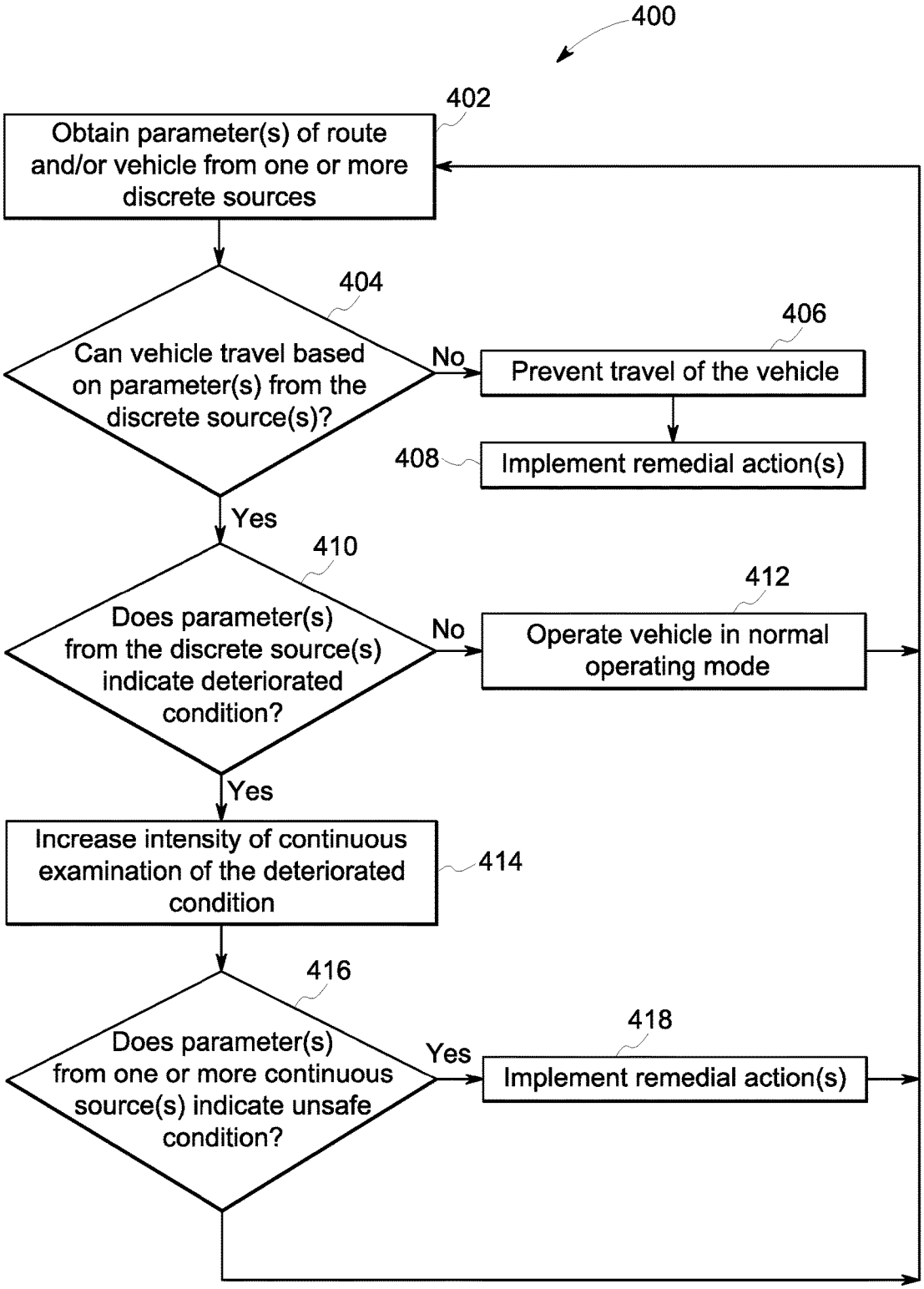
FIG. 4 illustrates a flowchart of one embodiment of a method for examining a vehicle and/or route.

FIG. 4 illustrates a flowchart of one embodiment of a method 400 for examining a vehicle and/or route. The method 400 may be performed by one or more embodiments of the vehicle systems, vehicles, and examination systems described herein. In one embodiment, the method 400 may represent or be used to generate a software program that directs at least some operations of the controller and/or examination system described herein.

At 402, one or more parameters of a route and/or vehicle are obtained from one or more discrete sources. The route and/or vehicle parameters may be obtained from a wayside unit, from a manual inspection, or another type of inspection of the route and/or vehicle that is not continuous in time and/or is not continuous in location. For example, the parameters may result from the periodic examination of the route and/or vehicle and/or from examination of the route and/or vehicle in a single location (but not other locations).

At 404, a determination is made as to whether the parameter obtained from the discrete source indicates that the vehicle should not travel along the route. For example, the obtained parameter may indicate that the damage to the route and/or vehicle is so severe that the vehicle cannot safely proceed with travelling beyond the location where the discrete examination of the route or vehicle occurred. As a result, flow of the method 400 can proceed toward 406. On the other hand, if the parameter from the discrete source indicates that continued travel of the vehicle is safe the flow of the method 400 can proceed toward 410.

At 406, travel of the vehicle is prevented. This system might cooperate with an existing vehicle control overlay, such as a positive train control (PTC) system. In one embodiment, the controller of the vehicle or vehicle system may prevent further movement of the vehicle or vehicle system over the portion of the route that is too badly damaged to safely travel over (as opposed to the PTC system that determines if the route is occupied with a preceding vehicle). At 408, one or more remedial actions can be implemented. These remedial actions alternatively can be referred to as control actions, and may include slowing or stopping movement of the vehicle system, automatically requesting inspection, maintenance, or repair of the vehicle system and/or route, communicating with an off-board location of the location of the damaged route and/or vehicle, communicating warnings to other vehicle systems of the damaged route, etc. Flow of the method 400 may terminate or return to 402. In an alternative embodiment, an existing PTC system may be the mechanism engaged so as to slow or stop the vehicle.

At 410, a determination is made as to whether the parameter from the discrete source indicates a deteriorated condition of the route and/or vehicle. The parameter may indicate a deteriorated condition of the route and/or vehicle when the route and/or vehicle are damaged, but not damaged so significantly that travel is not possible over the route. For example, such a parameter can indicate damage, but not a break, in the route; a bearing with an increased temperature but with an axle that is still able to rotate; a wheel having a non-circular segment along the outer perimeter of the wheel, but not yet a flat spot, etc. The parameter may not indicate a deteriorated condition of the route and/or vehicle when the route and/or vehicle are not damaged. If the parameter does not indicate a deteriorated condition, then flow of the method 400 can proceed toward 412. If the parameter indicates a deteriorated condition, then flow of the method 400 can proceed toward 414.

At 412, the vehicle can operate in a normal operating mode. In one embodiment, the normal operating mode includes the route and/or vehicle examination equipment 314, 310 not continually examining the route and/or vehicle. For example, one or more of the sensors may deactivate and not collect data representative of parameters of the route and/or vehicle. Flow of the method 400 can return toward 402 where additional parameters of the vehicle and/or route are obtained from another discrete source. This can involve the vehicle traveling to another location of a wayside unit or receiving additional information from a manual inspection of the vehicle and/or route.

At 414, the examination system 100 can increase an intensity at which continuous examination of a deteriorated condition is performed during a continuous operating mode. In one example, if no continuous examining of the route and/or vehicle is being performed prior to 414, then at 414, continuous examining may begin in a continuous operating mode. In another example, if at least some continuous examining of the route and/or vehicle is being performed prior to 414, then at 414, the intensity at which this continuous examination is occurring is increased. The intensity can be increased by increasing a frequency at which data is measured, by activating and using additional sensors to monitor the route and/or vehicle, by increasing a resolution of the data being measured, etc.

The continuous operating mode can include one or more of the vehicle or route examination equipment 310, 314 continually monitoring parameters of the vehicle and/or route. The continuous monitoring can include obtaining additional data of the condition or state of the vehicle and/or route from continuous sources (e.g., sources onboard the vehicle) between the discrete sources obtaining the data of the condition or state of the vehicle. Alternatively, the continuous monitoring can include obtaining several data points (or measurements of data) during movement of the vehicle over the route. Alternatively, the continuous monitoring can mean obtaining data representative of conditions of the route and/or vehicle from one or more sensors disposed onboard the vehicle.

At 416, the parameter obtained from the continuous sources is examined to determine if the parameter indicates an unsafe condition. The unsafe condition may indicate increasing severity or magnitude in damage to the route and/or vehicle, as identified by the continuous monitoring of the route and/or vehicle. For example, such a parameter can indicate increasing damage in the route as the vehicle progresses along the route; a bearing with increasing temperature; a wheel having the non-circular segment that is becoming more flat, etc. If the parameter indicates an unsafe condition, such as worsening damage of the vehicle and/or route, then flow of the method 400 can proceed toward 418. Otherwise, flow of the method 400 can return toward 402.

At 418, one or more control actions (e.g., remedial actions) can be implemented. These control actions can include slowing or stopping movement of the vehicle system, automatically requesting inspection, maintenance, or repair of the vehicle system and/or route, communicating with an off-board location of the location of the damaged route and/or vehicle, communicating warnings to other vehicle systems of the damaged route, etc. Flow of the method 400 may terminate or return to 402.

In one embodiment, a system (e.g., an examination system) includes a controller that is operable to receive information from a plurality of discrete information sources and from a continuous information source on-board a vehicle system. The controller also is operable to control one or both of speed and operation of the vehicle system based on the information received from the discrete information sources and the continuous information source.

In one embodiment, a system (e.g., an examination system) includes a controller and examination equipment. The controller is configured to obtain one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The controller also is configured to examine the one or more of the route parameter or the vehicle parameter to determine whether the one or more of the route or the vehicle system is damaged. The examination equipment is configured to continually monitor the one or more of the route or the vehicle system responsive to determining that the one or more of the route or the vehicle is damaged.

In one aspect, the controller is operable to receive at least a portion of the one or more of the route parameter or the vehicle parameter from a stationary wayside unit disposed alongside the route being traveled by the vehicle system.

In one aspect, the controller is operable to receive the at least the portion of the one or more of the route parameter or the vehicle parameter from the wayside unit that includes information relating to whether there is a problem or potential problem with a wheel of the vehicle system. In one aspect, the controller is operable to switch operating modes of the vehicle system based on at least one of the one or more of the route parameter or the vehicle parameter from the discrete examinations or information communicated from the examination equipment from continually monitoring the one or more of the route or the vehicle system.

In one aspect, at least one of the operating modes comprises the controller slowing or stopping movement of the vehicle system. In one aspect, at least one of the operating modes comprises the controller monitoring the vehicle system for one or more indications that a wheel is exhibiting a problem with the vehicle system. In one aspect, the controller is operable to receive the one or more of the route parameter or the vehicle parameter as information that is one or both of geographically discrete or temporally discrete. In one aspect, the examination equipment includes one or more of an asset health monitor or a broken rail detector.

In one aspect, the controller is configured to prevent or reduce a probability of occurrence of a derailment of the vehicle system due to at least one of a broken wheel, a locked axle, or a broken rail based on the one or more of the route parameter or the vehicle parameter received from the discrete examinations and information received from the examination equipment relative to the controller not receiving the one or more of the route parameter or the vehicle parameter and the information from the examination equipment.

In another embodiment, a method (e.g., for examining a route and/or vehicle system) includes obtaining one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The discrete examinations of the one or more of the route or the vehicle system are separated from each other by one or more of location or time. The method also includes examining the one or more of the route parameter or the vehicle parameter to determine whether the one or more of the route or the vehicle system is damaged and, responsive to determining that the one or more of the route or the vehicle is damaged, continually monitoring the one or more of the route or the vehicle system.

In one aspect, the one or more of the route parameter or the vehicle parameter is obtained from a stationary wayside unit disposed along the route. In one aspect, continually monitoring the one or more of the route or the vehicle system includes continually monitoring the one or more of the route parameter or the vehicle parameter from examination equipment disposed onboard the vehicle system. In one aspect, continually monitoring the one or more of the route or the vehicle system occurs between plural discrete examinations of the one or more of the route or the vehicle system.

In one aspect, the plural discrete examinations of the one or more of the route or the vehicle system one or more of occur during different, non-overlapping time periods or occur at different locations, with the continually monitoring of the one or more of the route or the vehicle system occurring one or more of between the different, non-overlapping time periods or between the different locations.

In one aspect, the method also includes implementing a control action responsive to determining that the one or more of the route or the vehicle system is damaged based on continually monitoring the one or more of the route or the vehicle system. The control action includes one or more of automatically slowing or stopping movement of the vehicle system, automatically requesting inspection, repair, or maintenance of the one or more of the route or the vehicle system, applying an adhesion-modifying substance to the route, preventing application of the adhesion-modifying substance to the route, lifting one or more axles of the vehicle system away from the route, or lowering the one or more axles of the vehicle system toward the route.

In one aspect, both the route parameter and the vehicle parameter are obtained from the discrete examinations of the route and the vehicle system, respectively. The route parameter and the vehicle parameter can be examined to determine whether the route or the vehicle system is damaged, respectively. The one or more of the route or the vehicle system can be continually monitored, responsive to the determining damage of the one or more of the route or the vehicle, to at least one of confirm or quantify the damage. The method also can include controlling the vehicle system responsive to the damage that is at least one of confirmed or quantified.

In one aspect, at least one of the route parameter or the vehicle parameter is obtained from a stationary wayside unit disposed along the route. Continually monitoring the one or more of the route or the vehicle system can include continually monitoring the one or more of the route parameter or the vehicle parameter from examination equipment disposed onboard the vehicle system.

In one embodiment, a system (e.g., an examination system) includes one or more processors and examination equipment. The one or more processors are configured to obtain one or more of a route parameter or a vehicle parameter from discrete examinations of one or more of a route or a vehicle system. The route parameter is indicative of a health of the route over which the vehicle system travels. The vehicle parameter is indicative of a health of the vehicle system. The one or more processors also are configured to examine the one or more of the route parameter or the vehicle parameter to determine whether the one or more of the route or the vehicle system is damaged. The examination equipment is configured to continually monitor the one or more of the route or the vehicle system responsive to the one or more processors determining that the one or more of the route or the vehicle system is damaged based on the one or more of the route parameter or the vehicle parameter.

In one aspect, the one or more processors are configured to receive the one or more of the route parameter or the vehicle parameter from a stationary wayside unit disposed along the route. In one aspect, the examination equipment is configured to be disposed onboard the vehicle system and to continually monitor the one or more of the route or the vehicle system during movement of the vehicle system.

In one aspect, the examination equipment includes one or more of a car sensor configured to measure a temperature of the vehicle system, an acoustic sensor configured to measure one or more ultrasound echoes or sounds of the vehicle system or the route, an impact sensor configured to measure one or more accelerations of the vehicle system, an optical sensor configured to one or more of obtain an image or video of the route or measure geometry of the route, or an electrical sensor configured to measure one or more electrical characteristics of the route. In one aspect, the examination equipment is configured to continually monitor the one or more of the route or the vehicle system between plural discrete examinations of the one or more of the route or the vehicle system.

In one aspect, both the route parameter and the vehicle parameter are obtained from the discrete examinations of the route and the vehicle system, respectively. The route parameter and the vehicle parameter can be examined to determine whether the route or the vehicle system is damaged, respectively. The examination equipment can continually monitor the one or more of the route or the vehicle system responsive to the determining damage of the one or more of the route or the vehicle to at least one of confirm or quantify the damage. The one or more processors can be configured to control the vehicle system responsive to the damage that is at least one of confirmed or quantified. In one embodiment, the one or more processors are configured to receive at least one of the route parameter or the vehicle parameter from a stationary wayside unit disposed along the route. The examination equipment is configured to be disposed onboard the vehicle system.

The above description is illustrative and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

track examination equipment configured to obtain plural track parameters indicative of a condition of a track segment of a track over which at least a first locomotive system and a second vehicle system travel, wherein the track examination equipment comprises a stationary wayside unit and a mobile track inspection unit, and the mobile track inspection unit comprises an inspection system mounted on the second vehicle system operating over the track prior to the first locomotive system;

locomotive examination equipment that is configured to generate a locomotive parameter that is indicative of an operational condition of the first locomotive system; and a controller configured to receive the track parameters and the locomotive parameter, the controller further configured to examine the track parameters to determine the condition of the track segment prior to the first locomotive system entering the segment, and the controller further configured to control at least one operational aspect of the first locomotive system in response to both the determined condition of the track segment and the locomotive parameter.

2. The system as defined in claim 1, wherein the stationary wayside unit comprises one or more of a visible light video sensor unit, an infrared sensor unit, or an electrical current sensor that is configured to determine if an electrical break or an electrical short has occurred in the segment of the track.

3. The system as defined in claim 1, wherein the stationary wayside unit is configured to provide substantially continuous signals indicating the condition of the track and the mobile track inspection unit is configured to provide substantially periodic signals indicating the condition of the track, and the controller is further configured to determine the condition of the track based at least in part on both the substantially continuous signals and on the substantially periodic signals.

4. The system as defined in claim 1, wherein the at least one operational aspect of the first locomotive system is the track, and the controller is operable to control the first locomotive system to change at least a portion of the track from a first track portion to a second track portion, if the first track portion has a segment that has the determined condition below a determined threshold value and if the second track portion does not include the segment with the determined condition.

5. The system as defined in claim 1, wherein the determined condition comprises a broken rail and the first locomotive system is a locomotive.

6. The system as defined in claim 1, wherein the determined condition comprises a rockslide or mudslide over the track.

7. The system as defined in claim 1, wherein the determined condition comprises a washout of the track.

8. The system as defined in claim 1, wherein the determined condition comprises a snow drift over the track.

9. The system as defined in claim 1, wherein the second vehicle system having the mobile track inspection unit is a drone, and the drone is configured to switch operating modes, the switch comprising shifting from a first operating mode of identifying the segment of the track having the determined condition to a second operating mode that comprises at least one of signaling a location of the segment, signaling a type of determined condition, signaling a location of the track examination equipment, signaling information about the segment of the track, performing additional sensing tests or procedures that are different from those used in the identifying of the segment, or controlling the track examination equipment movement, wherein controlling the track examination equipment movement comprises one or more of the drone hovering for a determined period proximate to the segment, landing proximate to the segment, parking the drone proximate to the segment, changing positions to obtain additional perspectives of the segment, or obtaining at least one of higher definition or closer images of the segment.

10. The system as defined in claim 1, wherein the first locomotive system comprises a rail vehicle and the second vehicle system comprises an aerial drone.

11. The system as defined in claim 1, wherein the first locomotive system comprises a first rail vehicle and the second vehicle system comprises a second rail vehicle that is not connected to the first rail vehicle.

12. The system as defined in claim 1, wherein the track examination equipment further comprises a second mobile track inspection unit mounted on the first locomotive system and configured to obtain the track parameters for the controller to control subsequent locomotive systems traveling along the track after the first locomotive system.

13. The system as defined in claim 1, wherein the second vehicle system comprises:

a drone or unmanned vehicle; or an inspection vehicle having the primary purpose of inspecting the track.

14. The system as defined in claim 13, wherein the second vehicle system comprises the drone, and the drone is configured to obtain images of the track using one or more of visible light video, infrared, Light Detection and Ranging (Lidar), ultrasound, or radar.

15. The system as defined in claim 14, wherein the drone is an aerial drone.

16. The system as defined in claim 1, wherein the at least one operational aspect of the first locomotive system is locomotive system speed of the first locomotive system, and the controller is operable to control the locomotive system speed over the track if the determined condition is below a determined threshold value.

17. The system as defined in claim 16, wherein the controller is operable to control the locomotive system speed to be zero or to stop the first locomotive system prior to the first locomotive system arriving at the segment of the track that has the determined condition below a determined threshold value.

18. A system comprising:

track examination equipment configured to obtain plural track parameters indicative of a condition of a track segment of a track over which at least a first locomotive system and a second vehicle system travel, wherein the track examination equipment comprises a stationary wayside unit and a mobile track inspection unit, and the mobile track inspection unit comprises an inspection system mounted on the second vehicle system operating over the track prior to the first locomotive system;

locomotive examination equipment that is configured to generate a locomotive parameter that is indicative of an operational condition of the first locomotive system; and a controller configured to receive the track parameters and the locomotive parameter, the controller further configured to examine the track parameters to determine the condition of the track segment prior to the first locomotive system entering the segment, and the controller further configured to control at least one operational aspect of the first locomotive system in response to both the determined condition of the track segment and the locomotive parameter, prior to the first locomotive system entering the segment, wherein the at least one operational aspect of the first locomotive system includes the track and locomotive system speed of the first locomotive system, and in a first mode the controller is operable to control the locomotive system speed over the track if the determined condition is below a determined threshold value, and in a second mode the controller is operable to control the first locomotive system to change at least a portion of the track from a first track portion to a second track portion, responsive to the first track portion having the segment that has the determined condition below the determined threshold value and the second track portion not having the segment with the determined condition.

19. The system as defined in claim 18, wherein the controller is operable to at least one of:

control the locomotive system speed to be zero or to stop the first locomotive system prior to the first locomotive system arriving at the segment of the track that has the determined condition below the determined threshold value; or control the locomotive system speed to below a speed ceiling for the first locomotive system such that below that speed ceiling the possibility of a designated event is below a determined confidence threshold level.

* * * * *